US006006681A

United States Patent [19]

Brown et al.

[11] Patent Number: 6,006,681

[45] Date of Patent: Dec. 28, 1999

[54] MODULAR TRANSACTION STATION

[75] Inventors: Michael E. Brown, Mason, Ohio; James M. Ferguson, Ft. Wright, Ky.; Michael J. Craven, Sycamore Township, Ohio

[73] Assignee: E. F. Bavis & Associates, Inc., Maineville, Ohio

[21] Appl. No.: 08/927,105

[22] Filed: Aug. 28, 1997

[51] Int. Cl.[6] ..... E06B 7/32

[52] U.S. Cl. ..... 109/19; 109/10

[58] Field of Search ..... 109/2, 5, 9–19, 109/24.1, 45–49, 55; 232/43.1, 43.3

[56] References Cited

U.S. PATENT DOCUMENTS

| | | | |
|---|---|---|---|
| Re. 24,723 | 10/1959 | Cornwell . | |
| 1,003,116 | 9/1911 | Madsen | 109/19 |
| 1,673,601 | 6/1928 | Spottswood | 109/19 |
| 1,977,719 | 10/1934 | Forseu | 109/10 X |
| 1,995,819 | 3/1935 | Rogers | 109/10 X |
| 2,015,868 | 10/1935 | O'Kieffe | 109/10 |
| 2,105,204 | 1/1938 | Soderholm | 109/19 |
| 2,648,300 | 8/1953 | Beedle | 109/19 |
| 2,707,426 | 5/1955 | Cooper . | |
| 2,722,179 | 11/1955 | Belew | 109/19 |
| 2,730,053 | 1/1956 | Ellithorpe | 109/19 |
| 2,830,331 | 4/1958 | Oakes . | |
| 2,949,870 | 8/1960 | Graber | 109/19 |
| 3,059,840 | 10/1962 | Graber et al. | 109/19 X |
| 3,077,243 | 2/1963 | Buros . | |
| 3,145,918 | 8/1964 | Higgins et al. | 129/19 X |
| 3,152,662 | 10/1964 | Buros | 109/19 X |
| 3,237,853 | 3/1966 | Grosswiller, Jr. | 232/43.3 |
| 3,298,329 | 1/1967 | Carstens, Jr. et al. | 109/10 |
| 3,390,833 | 7/1968 | Harris | 109/19 X |
| 3,615,050 | 10/1971 | Deaton et al. | 232/43.3 |
| 3,841,037 | 10/1974 | Clark | 52/36 |
| 3,842,320 | 10/1974 | Kiesling | 317/99 |
| 4,030,258 | 6/1977 | Anders | 109/10 X |
| 4,061,093 | 12/1977 | Carstens, Jr. et al. | 109/19 |
| 4,084,518 | 4/1978 | Carlson | 109/19 |
| 4,135,658 | 1/1979 | Hagberg | 232/43.1 |
| 4,157,071 | 6/1979 | King | 109/19 |
| 4,158,999 | 6/1979 | Sukolics | 109/19 |
| 4,170,947 | 10/1979 | Morgan | 109/16 |
| 4,190,003 | 2/1980 | Bourlier | 109/19 |
| 4,217,833 | 8/1980 | Sukolics | 109/19 |
| 4,294,380 | 10/1981 | Rankin | 109/19 X |
| 4,351,247 | 9/1982 | Clark | 109/19 |
| 4,393,789 | 7/1983 | Glotfelter | 109/19 |
| 4,640,200 | 2/1987 | Richardson | 109/19 |
| 4,735,289 | 4/1988 | Kenyon | 109/19 X |
| 5,099,623 | 3/1992 | Smith et al. | 52/201 |
| 5,375,380 | 12/1994 | Jones | 52/34 |

*Primary Examiner*—Suzanne Dino Barrett
*Attorney, Agent, or Firm*—Dinsmore & Shohl LLP

[57] ABSTRACT

A modular transaction station, comprising a frame; a monocoque counter assembly secured to the frame; and a pair of mounting sleeves extending about at least a portion of the periphery of the frame. The first mounting sleeve is secured to the frame, and the second mounting sleeve is securable to at least one of the frame and the first mounting sleeve, such that the transaction station may be secured within an opening in a wall with a portion of the wall bounding the opening positioned between the first and second mounting sleeves.

30 Claims, 17 Drawing Sheets

MODULAR TRANSACTION STATION

BACKGROUND OF THE INVENTION

1. Field of the Invention

The present invention relates to transaction stations which are used, for example, as bank teller windows. More particularly, the present invention provides a modular transaction station which combines a frame, a monocoque counter assembly and a mounting apparatus as an integral unit.

2. Description of Related Art

Numerous businesses utilize transaction stations whereby an attendant on one side of a wall or partition transacts business with a customer who is located on the other side. For example, such transaction stations have been used for many years by banks in order to provide its customers with drive-in teller windows. Bank customers can complete their transactions without ever having to leave their vehicle, while the bank teller remains protected within the building. Numerous other types of businesses, including, for example, gas stations and fast-food restaurants, also utilize similar transaction stations in order to transact business with customers without a need for the customer and attendant (e.g., a gas station attendant) to be physically located on the same side of the wall or other partition within which the station is located.

Transaction stations such as those described above generally require a counter assembly behind which the attendant is positioned, one or more panes of glass through which the customer and attendant may observe one another, a movable drawer or other device which allows the customer and attendant to exchange items (e.g., money, food, etc.), and a means for mounting the entire station within a wall or other partition. Often, these transaction stations must be specially built for each installation, and assembling the entire station can be a difficult and time-consuming process. Further complicating the production and installation of these transaction stations is the fact that most require electrical wiring to operate electronic drawers, audio systems, lighting and other necessary electronic equipment. Particularly in the case of bank teller windows, these transaction stations also must be sturdy and provide some measure of safety and security for the bank teller. Providing all of these features in a single transaction station, however, is generally a complicated and costly process, often requiring that each station be custom-designed for the particular needs of the business.

Thus, there is a need for a modular transaction station which provides all of the above-described features in a single, modular unit which may be readily installed in an opening in a wall or partition.

SUMMARY OF THE INVENTION

It is an object of the present invention to provide a modular transaction station which may be employed for any of a variety of applications.

It is another object of the present invention to provide a modular transaction station having an adjustable mounting apparatus which will enable the transaction station to be easily installed in a variety of openings.

It is yet another object of the present invention to provide a modular transaction station which has the necessary strength and rigidity yet employs relatively thin gauge panels for the counter assembly.

It is still another object of the present invention to provide a modular transaction station which has an integral air (or heat) plenum for directing conditioned air away from the station, as well as an integral wire chase for routing of electrical wiring.

It is another object of the present invention to provide a modular transaction station which need not be custom-designed for each installation.

In accordance with one embodiment of the present invention, the foregoing objects of the present invention can be provided by a modular transaction station, comprising:

(a) a frame;

(b) a counter assembly secured to the frame; and (c) a pair of mounting sleeves extending about at least a portion of the periphery of the frame.

The first mounting sleeve is secured to the frame (preferably in an adjustable manner), and the second mounting sleeve is securable (preferably in an adjustable manner) to at least one of the frame and the first mounting sleeve. In this manner, the transaction station may be secured within an opening in a wall such that a portion of the wall bounding the opening is positioned between the first and second mounting sleeves.

More preferably, the first mounting sleeve is adjustably secured to at least a portion of the periphery of the frame, and the second mounting sleeve is adjustably securable to the first mounting sleeve. In this manner, the second mounting sleeve may secured to the first mounting sleeve a variable distance from the first mounting sleeve. The first and second mounting sleeves preferably each have face portions which extend away from the frame, such that the transaction station may be secured within an opening in a wall by securing a portion of the wall bounding the opening between the face portions (either flush against each face portion or against a flange provided on each face portion). Furthermore, the frame should be substantially rectangular, and the first mounting sleeve should have a side panel which extends substantially perpendicularly away from the face portion of the first mounting sleeve and is secured about a portion of the periphery of the frame. A plurality of threaded members (such as bolts) extending away from at least one of the first mounting sleeve and the frame are provided, and the second mounting sleeve has a plurality of threaded fasteners (such as female-threaded nuts, or, more preferably, hollow, internally-threaded bolts) positioned about the second mounting sleeve. Thus, the second mounting sleeve may be adjustably secured to at least one of the first mounting sleeve and the frame by threadably securing the threaded members to fasteners. Of course it will be apparent that the female-threaded fasteners may be provided on one of the first mounting sleeve and the frame, with the threaded members (e.g., bolts) extending away from the second mounting sleeve.

The frame of the transaction station has upper and lower portions. A window may be positioned in the upper portion, while the counter assembly is attached to the lower portion of the frame. The counter assembly also further preferably comprises a transaction drawer moveable between extended and retracted positions.

The counter assembly comprises a plurality of rigid panels joined to one another so as to provide a substantially monocoque structure. An integral air plenum, as well as an integral wire chase are provided in the counter assembly. The air plenum allows conditioned air to be routed from (i.e., out of) the interior of the counter assembly, and away from the top surface of the counter assembly. The air plenum extends upwardly along either side of the transaction drawer within the counter assembly. Electrical wiring may be routed through the wire chase as needed.

Panels of the counter assembly preferably include:

a vertical front panel;

a pair of vertical outer side panels extending perpendicularly away from the front panel along either side of the counter assembly; and at least one interior front panel positioned within the interior of the counter assembly in a substantially facing, spaced-apart relationship from the front panel;

wherein at least a portion of the air plenum and at least a portion of the wire chase are located between the front panel and the at least one interior front panel. The plurality of panels may further include a pair of interior side panels, positioned within the interior of the counter assembly in a substantially facing, spaced-apart relationship from the outer side panels, and a horizontal top panel. The interior side panels are preferably positioned in a facing, spaced-apart relationship to one another so as to define a central opening in the counter assembly therebetween, such that an attendant may locate themselves within the central opening when using the transaction station. The top panel should have an opening therein which provides access to the transaction drawer.

Each of the panels preferably comprises thin, cold-finished steel sheet (preferably 11 gauge). The panels may initially be secured to one another by riveting, and thereafter welded to one another to form the rigid, monocoque structure. At least a portion of the air plenum may be located between the front panel and the at least one interior front panel, and at least a portion of the wire chase may be located between the front panel and the at least one interior front panel. Preferably, the air plenum extends upwardly adjacent at least one side, and more preferably along either side of said transaction drawer within said counter assembly, such that air may be directed from the interior of the counter assembly away from the top panel of said counter assembly (i.e., expelled from the interior of the counter assembly. One or more apertures may be provided in the top panel, and these apertures should be in communication with the air plenum such that air may be expelled from the plenum through these apertures. An air diffuser is also preferably positioned above the apertures, and said diffuser may be configured so as to direct the flow of air expelled from said plenum through said aperture in the desired direction (e.g., against the glass).

A plurality of the panels may each have at least one flange along an edge thereof, the flanges having a plurality of apertures extending therethrough. These apertures in the flanges correspond to apertures in an adjacent panel when the panels are arranged in their intended final configuration, and a plurality of fastening devices (such as rivets) secured within corresponding apertures on adjacent panels can be used to secure the panels to one another. Spot welding is preferably later employed to further secure the panels to one another.

BRIEF DESCRIPTION OF THE DRAWINGS

While the specification concludes with claims particularly pointing out and distinctly claiming the present invention, it is believed that the same will be better understood from the following description read in conjunction with the accompanying drawings in which:

DESCRIPTION OF THE PREFERRED EMBODIMENTS

Figure 1:
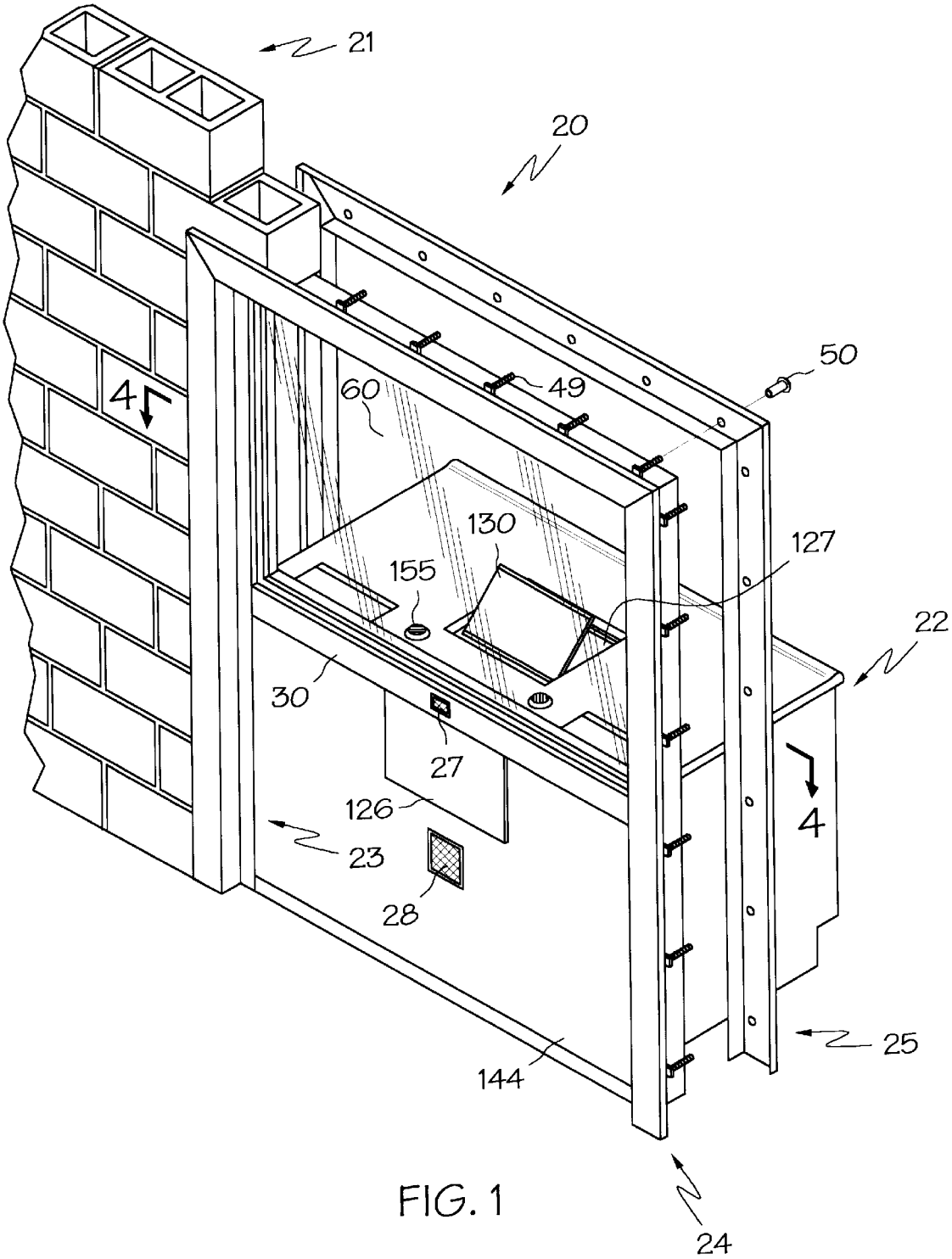
FIG. 1 is a perspective view of one embodiment of the modular transaction station of the present invention, wherein the station is positioned within an opening in a brick wall (only a portion of the brick wall is shown)

Referring now to the drawings in detail, wherein like numerals indicate similar elements throughout the views, FIG. 1 depicts one embodiment of the modular transaction station 20 of the present invention. As will be described more fully herein, modular transaction station 20 may be readily secured within an opening in a wall or other partition. In the example of FIG. 1, transaction station 20 is positioned in a rectangular opening in brick wall 21. As is apparent, only the left side of brick wall 21 is shown in FIG. 1 for purposes of clarity. Thus, brick wall 21 will extend along the right and left sides of transaction station 20, as well as across its top surface. In addition, FIG. 1 depicts transaction station 20 configured for use as a bank teller drive-up window. The present invention, however, is not limited to this use, as the modular transaction station of the present invention may be employed in any of a variety of situations wherein a transaction station is to be positioned in an opening in a wall or other partition (e.g., a restaurant drive-up window or a gas station window).

The modular transaction station of the present invention generally comprises three principle components; namely, counter assembly 22, frame 23, and a mounting apparatus comprising front and rear mounting sleeves 24 and 25, respectively. When the components of station 20 are secured to one another in an opening in a wall or partition using the mounting apparatus, a ridged, aesthetically-pleasing, and, most importantly, a highly-functional transaction station is provided. The arrangement of frame 23, mounting sleeves 24 and 25, as well as counter assembly 22 also allows the transaction station to be easily installed in a variety of situations.

Figure 2:
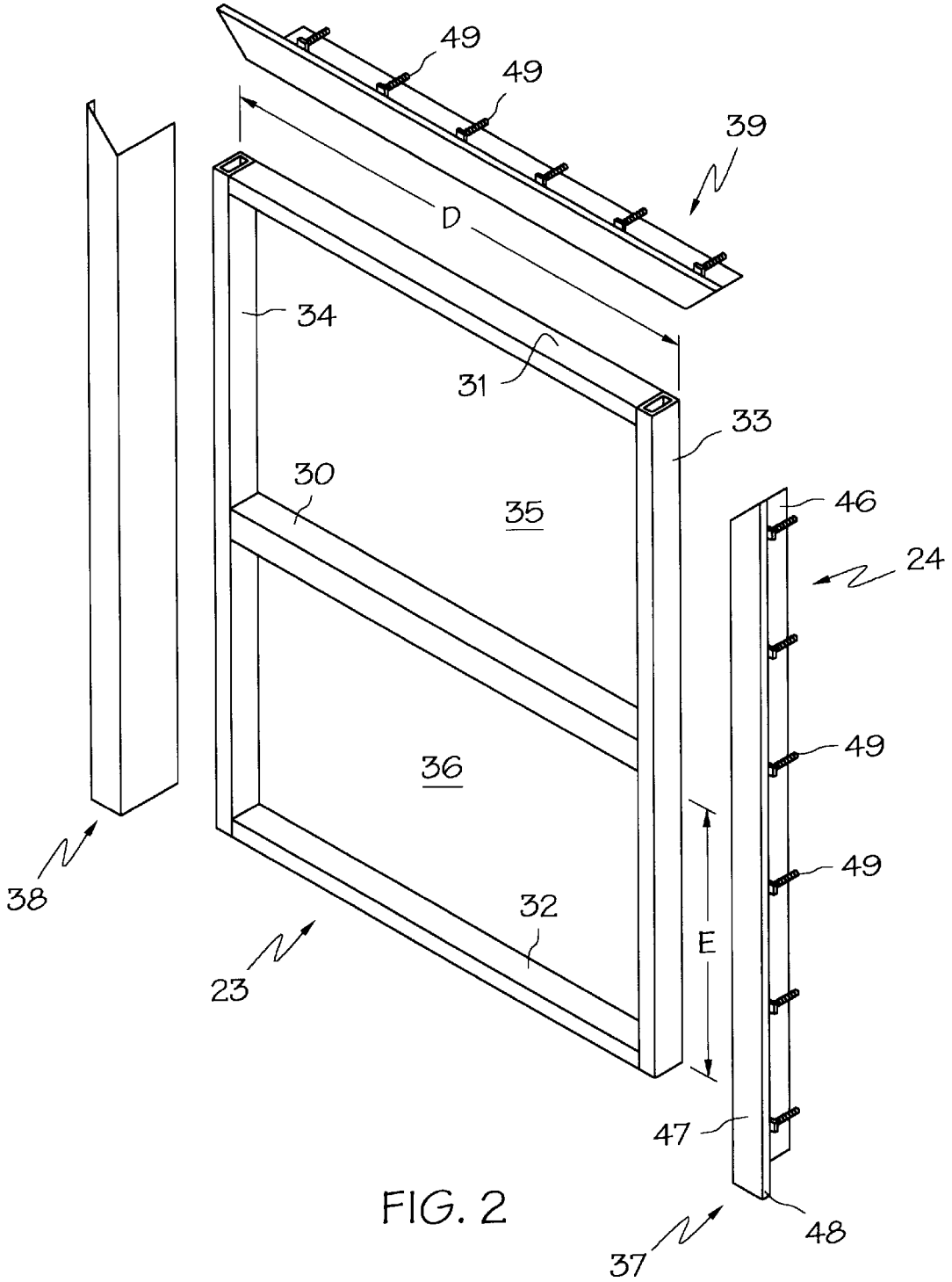
FIG. 2 is a perspective, exploded view of the frame and front mounting sleeve of the transaction station of FIG. 1.

Turning first to the frame assembly, as best shown in FIG. 2, frame 23 generally comprises a top frame member 31, a bottom frame member 32, a right frame member 33, and a left frame member 34. Each of these frame members are secured to one another in the manner shown in order to provide a rectangular frame 23. These frame members should generally comprise a rigid material (such as steel or other metal), and in the example shown each comprises rectangular steel tubing. The steel tubing of each of the frame members may be welded or bolted together in order to provide a secure construction for frame 23.

A central transom 30 also preferably extends laterally across the frame in order to provide not only additional support, but also a lower support member for a window assembly (to be described further herein). Central transom 30 may also comprise rectangular steel tubing which is welded to the other members. In a preferred embodiment, central transom 30 is somewhat larger than the outer frame members 31–34, not only to provide additional support but also to provide additional surface area for the mounting of features such as a microphone. In one preferred embodiment, central transom 30 comprises approximately four inch by four inch rectangular steel tubing, while the outer frame members are approximately two inch by four inch steel tubing.

Although each of the frame members may comprise a solid, rigid material, the preferred hollow tubing provides the added benefit of a channel through which wiring or other materials may be passed. For example, as best shown in FIG. 1, a microphone 27 may be mounted on the outer surface of central transom 30 as shown. The wiring for microphone 27 may then pass through the interior of transom 30 and thereafter connect to audio and electrical systems for the transaction station. In this manner, central transom 30 provides a convenient mounting location for microphone 27, or any of a variety of other features as may be desired (e.g., a speaker, a buzzer, etc.).

Frame 23 may be directly mounted in an opening in a wall or other partition, such as by bolting the frame directly to the wall itself. A variety of alternative, conventional mounting means may also be readily employed, as is known to those skilled in the art. It is preferred, however, that a separate mounting apparatus comprising one or more mounting sleeves be employed for securing frame 23 to the wall. The mounting sleeve assembly of the present invention will account for variations in wall thickness and alignment, while also providing a rigid, aesthetically-pleasing means for quickly securing frame 23, and subsequently the entire transaction station to the wall or partition. In addition, the mounting sleeve assembly of the present invention is generally non-permanent in that it may be easily disassembled should one desire to later remove the transaction station from the wall within which it is mounted. As best shown in FIGS. 2–5, front and rear mounting sleeves 24 and 25, respectively, are preferably employed. One of the mountings sleeves is secured to frame 23, either in a predetermined or an adjustable arrangement, while the other sleeve is adjustably secured to either the first sleeve member or frame 23. Each of the mounting sleeves has a face portion which extends away from frame 23 so as to overlie wall 21 positioned adjacent thereto. Preferably, the second mounting sleeve is adjustably secured to frame 23 or the first mounting sleeve such that the edge of wall 21 positioned adjacent frame 23 may be securely wedged between the face portions of the first and second mounting sleeves. In a preferred embodiment described more fully below, the second mounting sleeve may be threadably secured to the first mounting sleeve in an adjustable manner such that as the second sleeve is drawn towards the first, the face portion of the two sleeves will be drawn towards wall 21 so as to wedge the interior edge of the wall therebetween.

Figure 4:
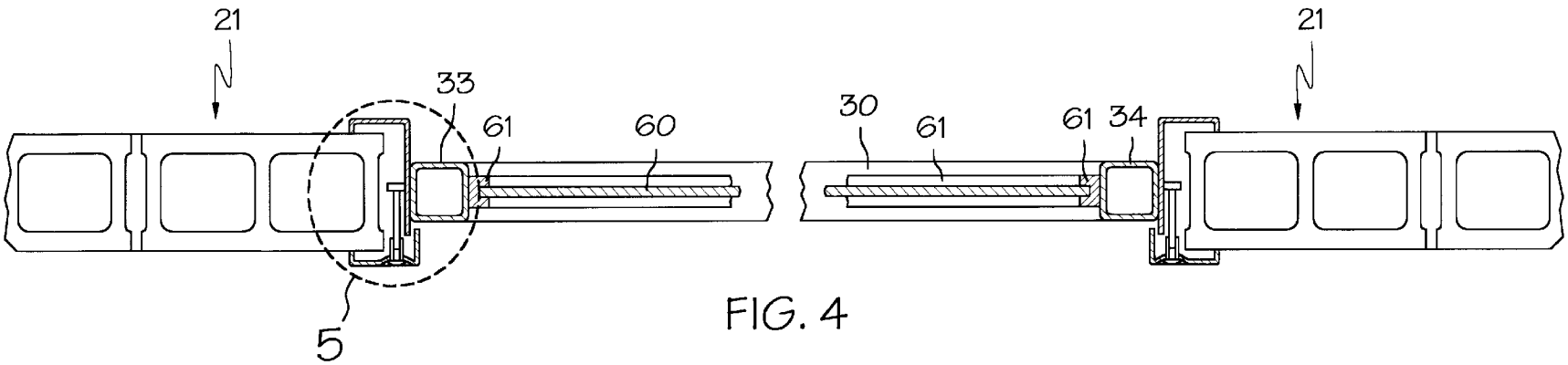
FIG. 4 is a top, cross-sectional view of the transaction station of FIG. 1, taken alone the line 4—4 thereof.
Figure 5:
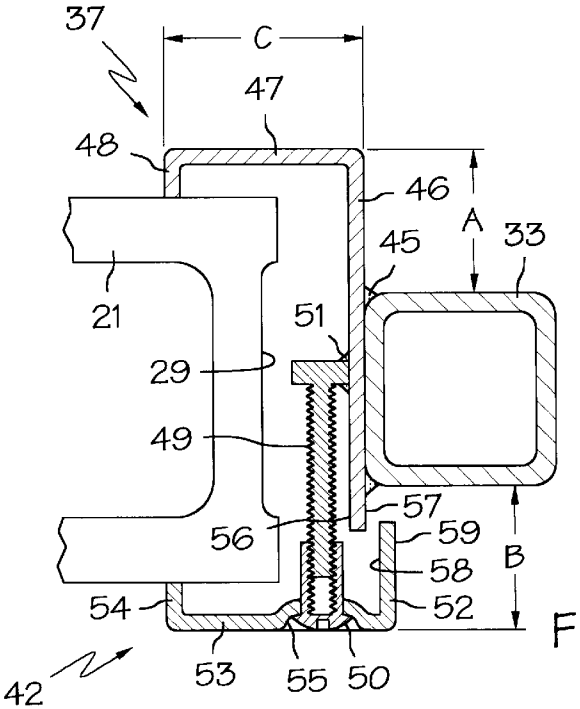
FIG. 5 is a top, cross-sectional view of the right frame member, front and rear mounting sleeves, and brick wall of the embodiment shown in FIG. 4.

In a preferred embodiment, front mounting sleeve 24 is secured to the outer surface of the top, right and left frame members (31, 33 and 34), while rear mounting sleeve 25 is adjustably secured to front mounting sleeve 24. If desired, rear mounting sleeve 25 can be adjustably secured to the frame members in the same manner. The portion of the wall or partition surrounding the opening therein (such as bricks 21) may then be wedged between the front and rear mounting sleeves as shown in FIGS. 4 and 5. Since front mounting sleeve 24 is secured to the outer surfaces of frame 23, this results in frame 23 being rigidly secured to brick wall 21.

Each mounting sleeve assembly is preferably configured as an inverted "U", and each further preferably comprises three members joined together in this configuration. Thus, front mounting sleeve 24 is formed from right portion 37, left portion 38 and top portion 39. Both ends of top portion 39, as well as the upper ends of right portion 37 and left portion 38 which meet top portion 39, may be mitered as shown in order to provide rigid, aesthetically-pleasing junctures between the three portions of front sleeve 24. Alternatively, and as presently preferred, the ends may merely be butt-fitted to one another, including an allowance for overlap of the three portions (37, 38 and 39) as needed. Butt-fitting will allow the mounting sleeve to be installed as three separate pieces, thereby accomodating variations in the size of the wall opening. Rear mounting sleeve 25 is also preferably configured in an inverted "U" shape, and is formed from right portion 42, left portion 43, and top portion 44. Once again the ends of these members may be mitered as shown, or may be butt-fitted (as presently preferred).

Front and rear mounting sleeves 24 and 25 may be made from any of a variety of rigid materials, however cold finished steel (14 gauge) is preferred. While each portion of the front and rear mounting sleeves may generally comprise a section of angle iron, the preferred embodiment for each has an additional flange which will butt against the wall or partition (such as brick wall 21). Thus, as best shown in FIGS. 2 and 5, right portion 37 of front mounting sleeve 24 generally comprises a side panel 46, a front face 47 and a flange 48. These three sections of right portion 37 of front mounting sleeve 24 generally form an "L" shape as shown in FIG. 5. Left portion 38 and top portion 39 of sleeve 24 are similarly configured. The outer surface 57 of side panel 46 generally abuts the outer surface of right frame member 33 as shown in FIG. 5. Side panel 46 may be secured to right frame member 33 by any of a variety of means, including bolts or welding. In the embodiment shown in FIG. 5, side panel 46 is merely welded to right frame 33 at weld 45, thereby securing right portion 37 of front sleeve 24 to the frame.

Figure 6:
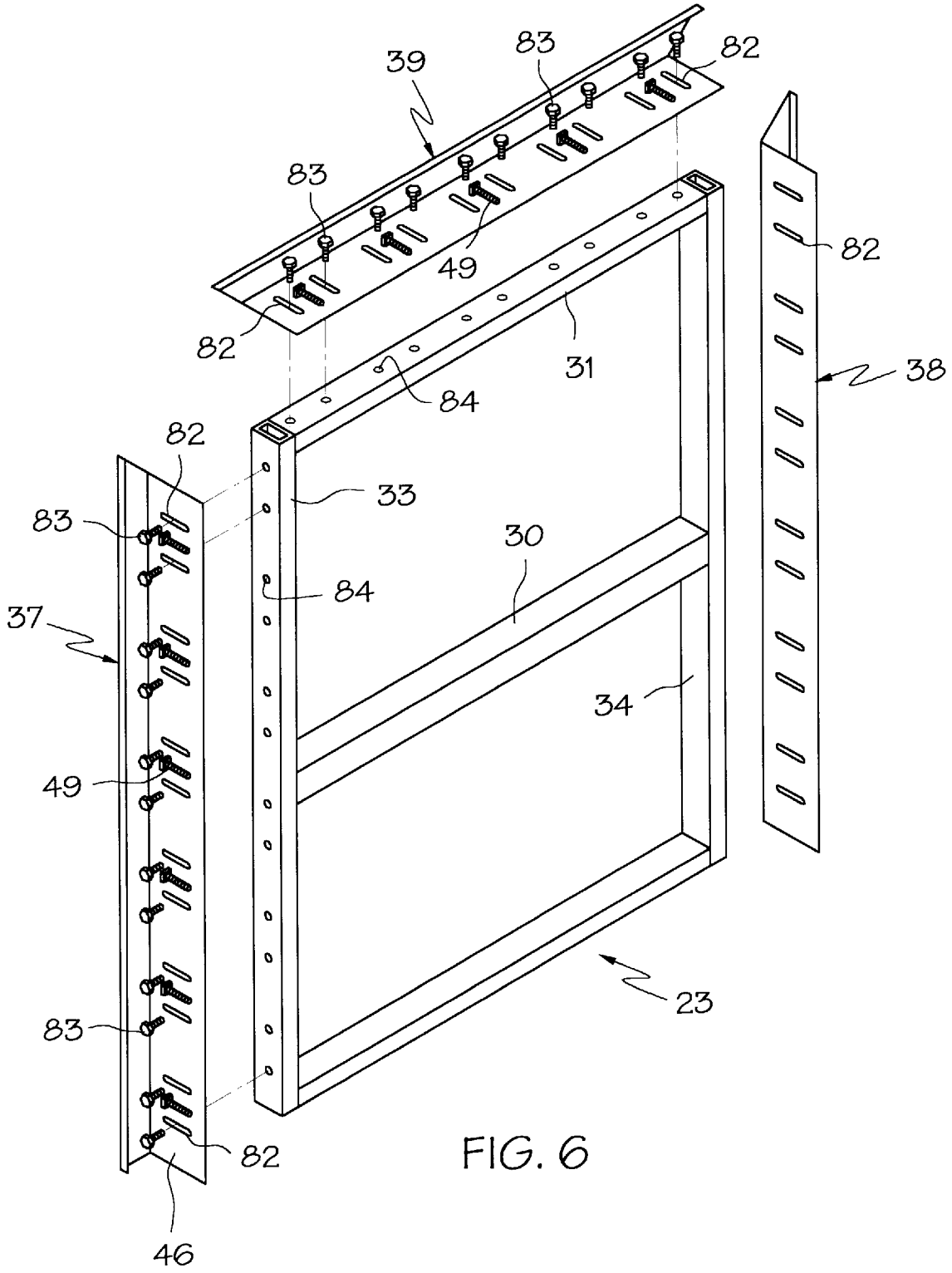
FIG. 6 is a perspective, exploded view of an alternative embodiment for the frame and front mounting sleeve of the transaction station.

Alternatively, a plurality of bolts may extend through side panel 46 into correspondingly-threaded female openings in right frame member 33. In particular, as shown in FIG. 6, bolting front mounting sleeve 24 to frame 23 can provide a simple means of adjusting the mounting sleeve relative to the frame in order to accommodate plum problems with the wall or partition to which the transaction station is to be secured. Specifically, oblong (e.g., rectangular or elliptical) apertures 82 may be provided in each of the side panels (e.g., side panel 46) of the three portions of mounting sleeve 24. Apertures 82 should be sized so as to accommodate the shank of bolts 83, while also permitting the shank to be slid laterally within the aperture and preventing the head of bolts 83 to pass therethrough. Bolts 83 may be secured within correspondingly threaded female recepticals 84 on frame 23. Although female recepticals 84 on the frame members are all in fixed locations, the oblong apertures 82 through which bolts 83 extend permit the mounting sleeve to be adjustably secured to right frame member 33. For example, if the wall to which the station is to be secured is slightly out of plum (e.g., not precisely vertical), front mounting sleeve 24 may be secured to frame 23 such that frame 23 may be positioned within the opening in the wall in a precise, vertical orientation as shown in FIG. 1. At the same time, the front face 47, or when employed, the flange (shown as 48 in FIG. 5), of the front mounting sleeve will directly abut the wall. In this manner, frame 23 will be located in its desired vertical orientation, while front mounting sleeve 24 will be secured flush against the wall which is out of plum.

Figure 14:
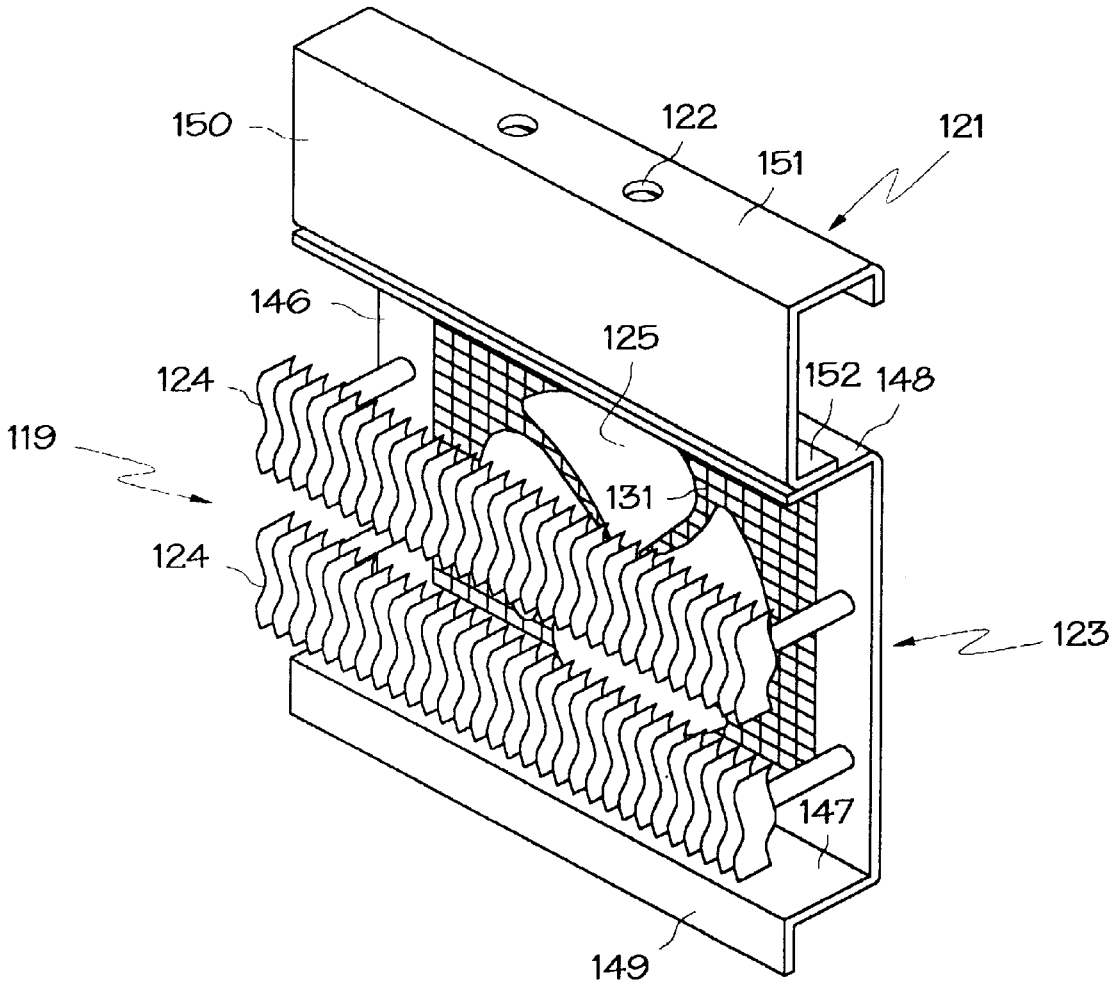
FIG. 14 is a perspective view of the heater assembly used in the transaction station.

Regardless of the means by which side panel 46 is secured to right frame member 33 (welding, bolting or other means known to those skilled in the art), side panel 46 preferably extends beyond the front surface of right frame member 33. In this manner, the frame member will be spaced rearwardly of front face 47 by distance A as shown in FIG. 5. Distance A will vary depending upon a number of factors, including the thickness of wall 21. When the adjustable mounting method of FIG. 14 is employed, distance A can also be readily varied as desired.

Front face 47 of the front mounting sleeve extends perpendicularly away from side panel 46, and thereby overlies the front face of wall 21 when the transaction station is installed. The width C of front face 47 (see FIG. 5) is preferably selected as needed, however, it is preferred that at least about 2 inches of front face 47 overlay wall 21. In addition, although front face 47 may, if desired, lie flush against wall 21, it is preferred that a short flange 48 extend perpendicularly away from front face 47 towards wall 21. Since wall 21 will often not be perfectly smooth, particularly in the case of brick, when flange 48 is not employed irregular surfaces of the wall will urge front face 47 away from wall 21 so as to create significant gaps between front face 47 and wall 21. When flange 48 is employed, however, the mounting sleeve may be positioned against the wall such that flange 48 abuts against wall 21 as shown. The irregular surface of the wall can be marked, and reliefs for flange 48 may then be chiseled or ground into wall 21 as needed. Since the portion of flange 48 which abuts against wall 21 comprises a thin strip of metal, only a narrow strip of wall 21 will be chiseled or ground away in order to accommodate flange 48. If flange 48 is not employed, the task of chiseling away portions of wall 21 which irregularly abut front face 47 would be extremely difficult. As an alternative to chiseling or grinding away portions of wall 21, any irregularities in wall 21 may be marked on flange 48. Flange 48 may then be trimmed using these marks as a guide (i.e., "scribing to fit)" in order to allow flange 48 to abut flush against wall 21. Were flange 48 not used, it would be impossible to trim away portions of front face 47 to account for wall surface irregularities.

Figure 3:
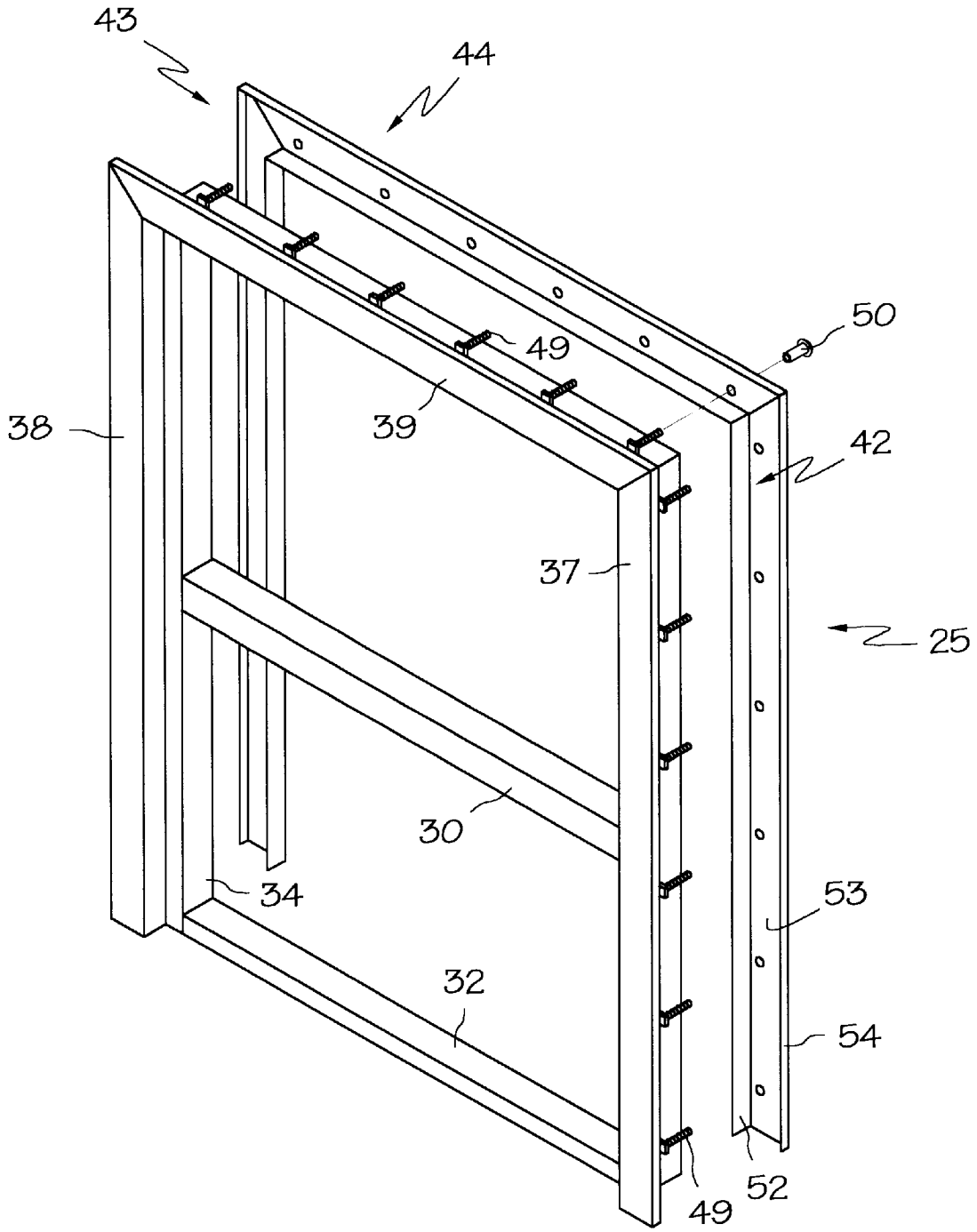
FIG 3 is a perspective, exploded view of the frame, and front and rear mounting sleeves of the transaction station of the present invention.

The construction of each portion of rear mounting sleeve 25 is similar to that of front mounting sleeve 24 in that it comprises a side panel, a rear face portion and an optional flange. By way of example, right portion 42 of rear mounting sleeve 25 comprises side panel 52, rear face 53 and flange 54 (as best shown in FIGS. 3 and 5). Rear mounting sleeve 25 is preferably adjustably securable to either front mounting sleeve 24 or frame 23 such that rear face 53 extends parallel to front face 47. In this manner, wall 21 may be wedged between front face 47 and rear face 53.

In a preferred embodiment, rear mounting sleeve 25 is adjustably secured to front mounting sleeve 24 by means of bolts 49 and 50. As shown in FIG. 5, bolt 49 is preferably secured to inner surface 56 of side panel 46 of front mounting sleeve 24 as shown, such that bolt 49 extends rearwardly towards rear mounting sleeve 25. A hollow bolt 50 having interior threads corresponding to the exterior threads on bolt 49 extends through bore 55 in rear face 53 of the rear mounting sleeve towards bolt 49. Preferably, bore 55 is counter-sunk so that the head of hollow bolt 50 will lie flush with the outer surface of rear face 53. As each hollow bolt 50 is rotated about bolt 49, it is advanced further along the threaded shank of bolt 49, thereby drawing rear mounting sleeve 25 towards front mounting sleeve 24. Bolt 50 is tightened until flange 54 abuts brick wall 21, as shown, thereby securely wedging brick wall 21 between flange 48 of front mounting sleeve 24 and flange 54 of rear mounting sleeve 25. As was the case for front mounting sleeve 24, flange 54 on rear mounting sleeve 25 may be omitted such that the interior surface of rear face 53 abuts directly against wall 21. It should also be noted that the gap between exterior surface 57 of side panel 46 and interior surface 58 of side panel 52 has been exaggerated slightly, as it is preferred that these two surfaces slidingly abut against one another in order to improve rigidity. In fact, rigidity can be further improved by positioning side panel 52 along the interior surface 56 of side panel 46 such that exterior surface 59 of side panel 52 abuts against interior surface 56 of side panel 46.

The width of rear face 53 of the rear mounting sleeve preferably is approximately equivalent to width C of front face 47 of front mounting sleeve 24, thereby ensuring that the front and rear mounting sleeves overlie wall 21 approximately the same distance. Frame 23 (as shown by right frame member 33 in FIG. 5) is also spaced forwardly of rear face 53 of rear mounting sleeve 25 by distance B. Distance B will vary depending upon a number of factors, including the thickness of wall 21, as well as the desired position of the transaction station in relation to the wall thickness. Although often times distances A and B will be equivalent, distance A may be greater in order to accommodate the multiple front panel layers described more fully below.

The above-described mounting apparatus comprising front and rear mounting sleeves 24 and 25 provides a rigid, adjustable means for securing frame 23 to the wall opening. Furthermore, since frame 23 is spaced away from interior surface 29 of the wall opening (see FIG. 5), and since the spacing between interior surface 29 and frame 23 may be varied depending in particular upon the width of front face 47 and rear face 53 of the front and rear mounting sleeves, respectively, frame 23 need not be precisely sized to match the size of the opening in wall 21. This further adds to the versatility of the modular transaction station of the present invention, and provides a station which can be mass produced for a variety of applications.

Turning now to counter assembly 22, this assembly preferably comprises a monocoque arrangement of rigid sheet material. Stretched sheets (or skins) of material form the outer surfaces of the counter assembly, and the majority of the torsional and bending stresses experienced by the counter is withstood by the sheet material (rather than support beams and reinforcing members). Preferably, counter assembly 22 comprises sheet steel (more preferably, at least 11 gauge, cold finished steel). Other rigid, preferably metallic, materials may be employed, however steel is preferred because of its low cost, ease of fabrication, rigidity and light weight. Counter assembly 22 is essentially formed of a plurality of panels made from sheet steel (i.e., skins), each of which is rigidly integrated with one another so as to provide a steel skin for the counter assembly. Because of this rigid integration (preferably by welding the sheets directly to one another), relatively thin gauge metal can be utilized without the need for additional support members as commonly employed in prior art steel cabinetry (such as corner supports and other reinforcing members).

In order to simplify the rigid integration of the sheet material of counter assembly 22, each sheet (or panel) preferably intersects adjoining panels at 90° angles. More importantly, at least a portion of the intersections where two panels are to be secured to one another, at least one of the panels is provided with a perpendicular flange. In this manner, a panel can be initially pop-riveted to an abutting panel by driving a rivet through the flange and the opposing panel against which the flange lies. Such flanges can be readily provided in the sheet material utilizing a conventional brake, or other means well-known to those skilled in the art. After the panels have been initially pop-riveted, they may be permanently secured along the same junctures by means of spot welding, bolting, or other suitable means known to those skilled in the art for rigidly connecting panels perpendicularly to one another. The result is a monocoque counter assembly formed from stretched skins of sheet material (such as thin gauge sheet steel).

Figure 7:
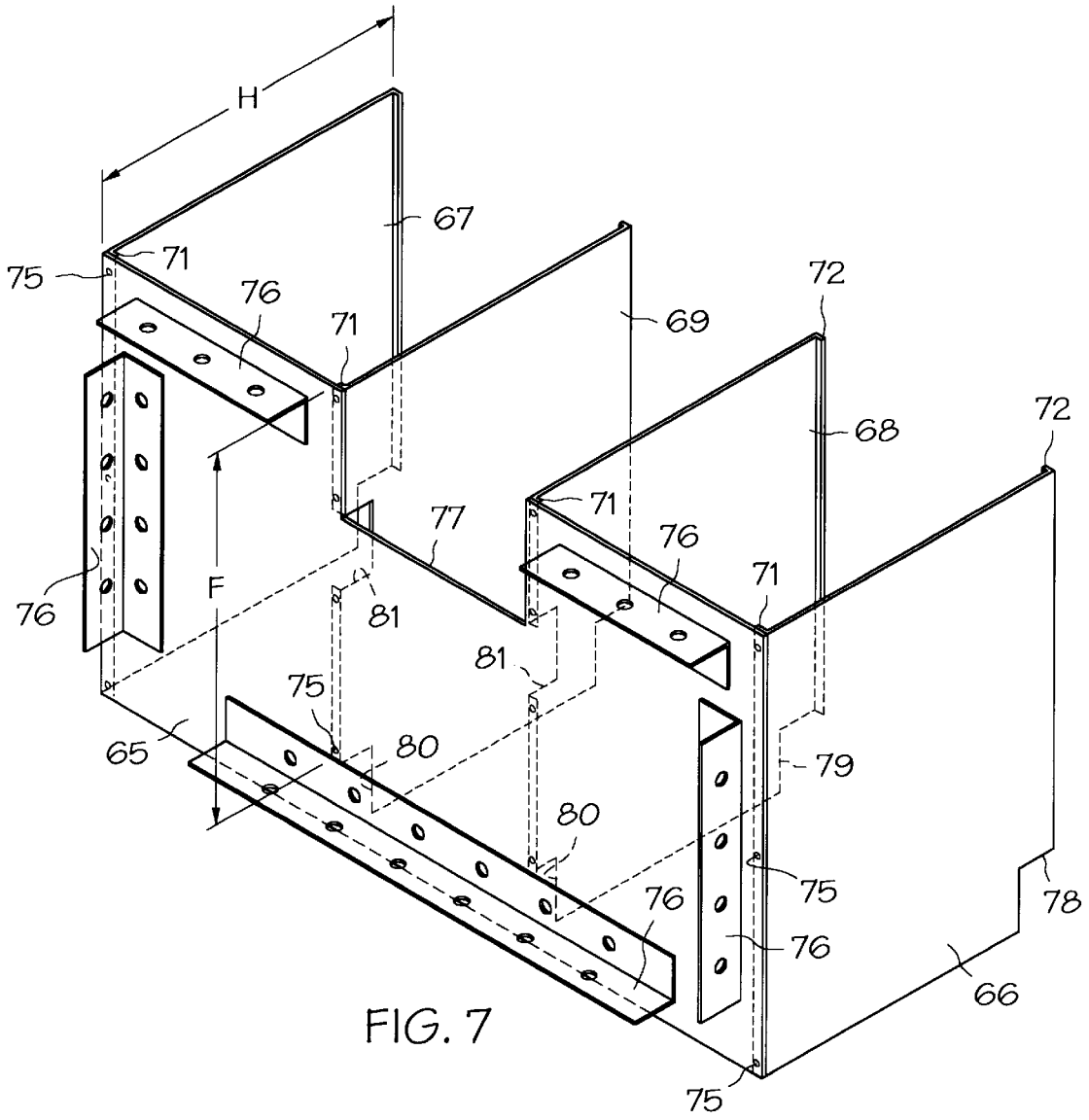
FIG. 7 is a perspective view of one embodiment of the counter assembly of the modular transaction station shown in FIG. 1.

With regard to the specific panel members from which counter assembly 22 is formed, FIG. 7 depicts front panel 65, right and left outer (or exterior) side panels 66 and 67, and right and left interior side panels 68 and 69, respectively. Each of the four side panels (66–69) are perpendicularly secured to front panel 65. In order to accomplish this rigid integration, each of the side panels has a flange 71 which extends perpendicularly away from the surface of the side panel such that each flange 71 will overlie the interior surface of front panel 65. Rivets 75 may then be driven through aligned apertures in front panel 65 and flange 71 of the side panels in order to secure the side panels perpendicularly front panel 65 in the manner shown in FIG. 7. By providing aligned apertures for rivets 75, the panels of the counter assembly are essentially self-jigging. After riveting, the side panels may be more permanently secured to front panel 65 by welding (or other suitable means).

Figure 17:
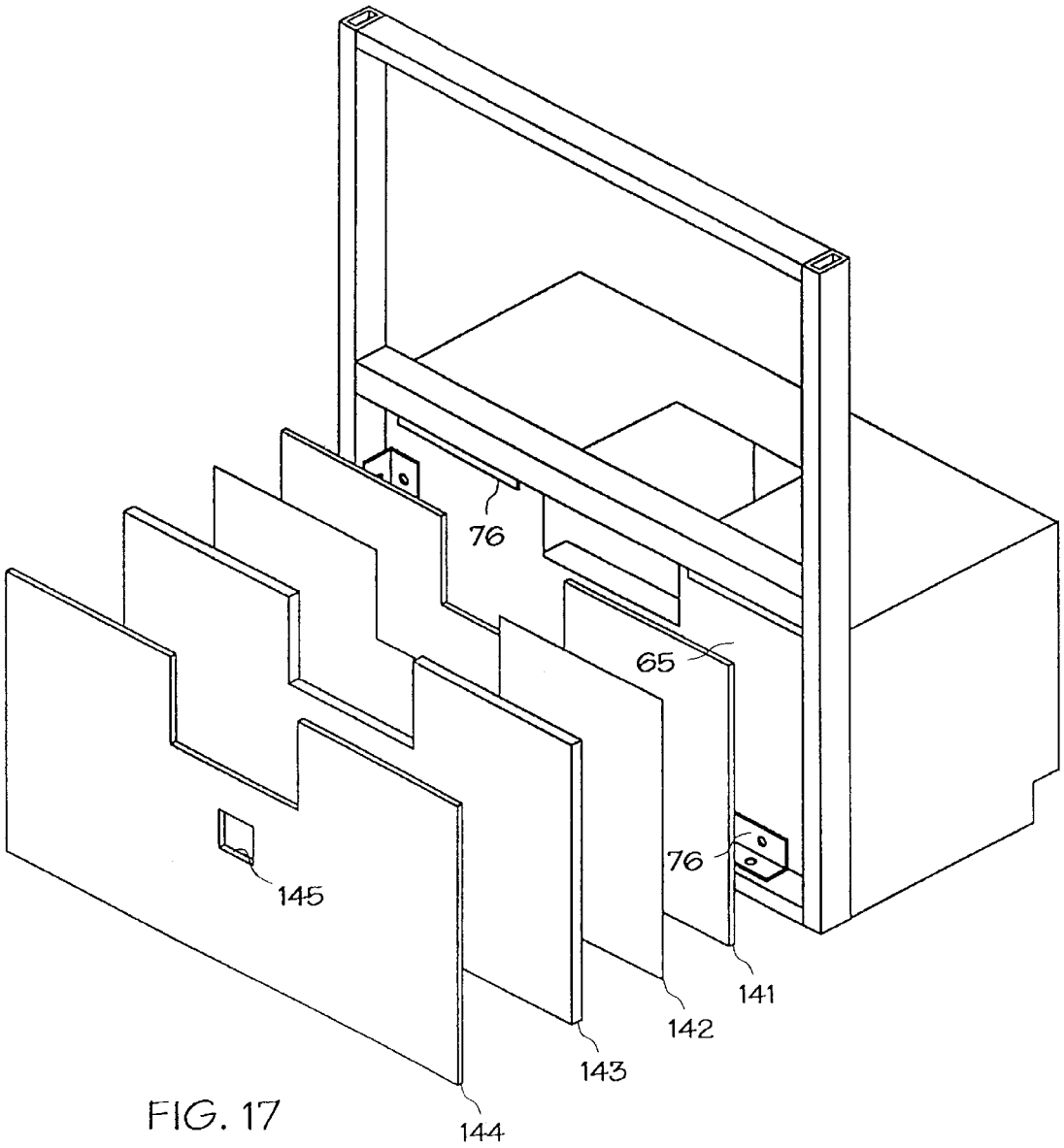
FIG. 17 is a perspective view of the modular transaction station wherein the front cover panels are depicted in exploded view.

The dimensions of the panels shown in FIG. 7 can vary considerably depending upon the intended use of the transaction station of the present invention. The dimensions of front panel 65, however, will be dictated by the dimensions of frame 23, since front panel 65 will eventually be secured to the interior surface (i.e., the side facing away from the front face of the station) of frame 23 as shown in FIG. 17. Thus, it is preferred that front panel 65 have a width which approximates width D of frame 23 (see FIG. 2), and a height which is slightly greater than the height E of the lower half of frame member 23 (i.e., the distance between the lower surface of bottom frame member 32 and the underside of central transom 30). In this manner, front panel 65 may be secured to the interior surface of the lower portion of right and left frame members 33 and 34, as well as at least a portion of central transom 30.

While front panel 65 may secured to these frame members by conventional welding, it is preferred that a plurality of mounting angles 76 be employed. As shown in FIG. 7, steel mounting angles 76 are secured to front panel 65 as shown. Preferably, a mounting angle 76 extends across the bottom, right, left and top edges of front panel 65. Along the top edge, a pair of mounting angle 76 should be employed in order to account for the drawer opening provided by cutout portion 77 described below. Mounting angles 76 may be secured to front panel 65 by any of a variety of means, however, steel-steel rivets are preferred in order to provide the necessary rigidity. Mounting angles 76 should be positioned along front panel 65 such that they may be employed to secure the counter assembly to the frame as shown in FIG. 17. Once again although mounting brackets 76 may be welded to the frame, it is preferred that steel-steel rivets be used for this purpose. One particular advantage provided by the use of mounting bracket 76 is that permits the frame and counter assemblies to be separately finished. In many instances, it is preferred that the frame be provided in a color different from that of the counter assembly. Mounting bracket 76 allow this to be accomplished since after finishing (such as by powder coating) the counter assembly may be rigidly secured to the frame using mounting brackets 76.

As further shown in FIG. 7, front panel 65 also has a cutout portion 77 which has a generally U-shaped configuration. When the top panel 85 (described more fully below) and countertop 90 are positioned atop side panels 66-69, cutout 77 and the underside of top portion 85 will provide a rectangular opening which will accommodate a transaction drawer assembly.

Figure 12:
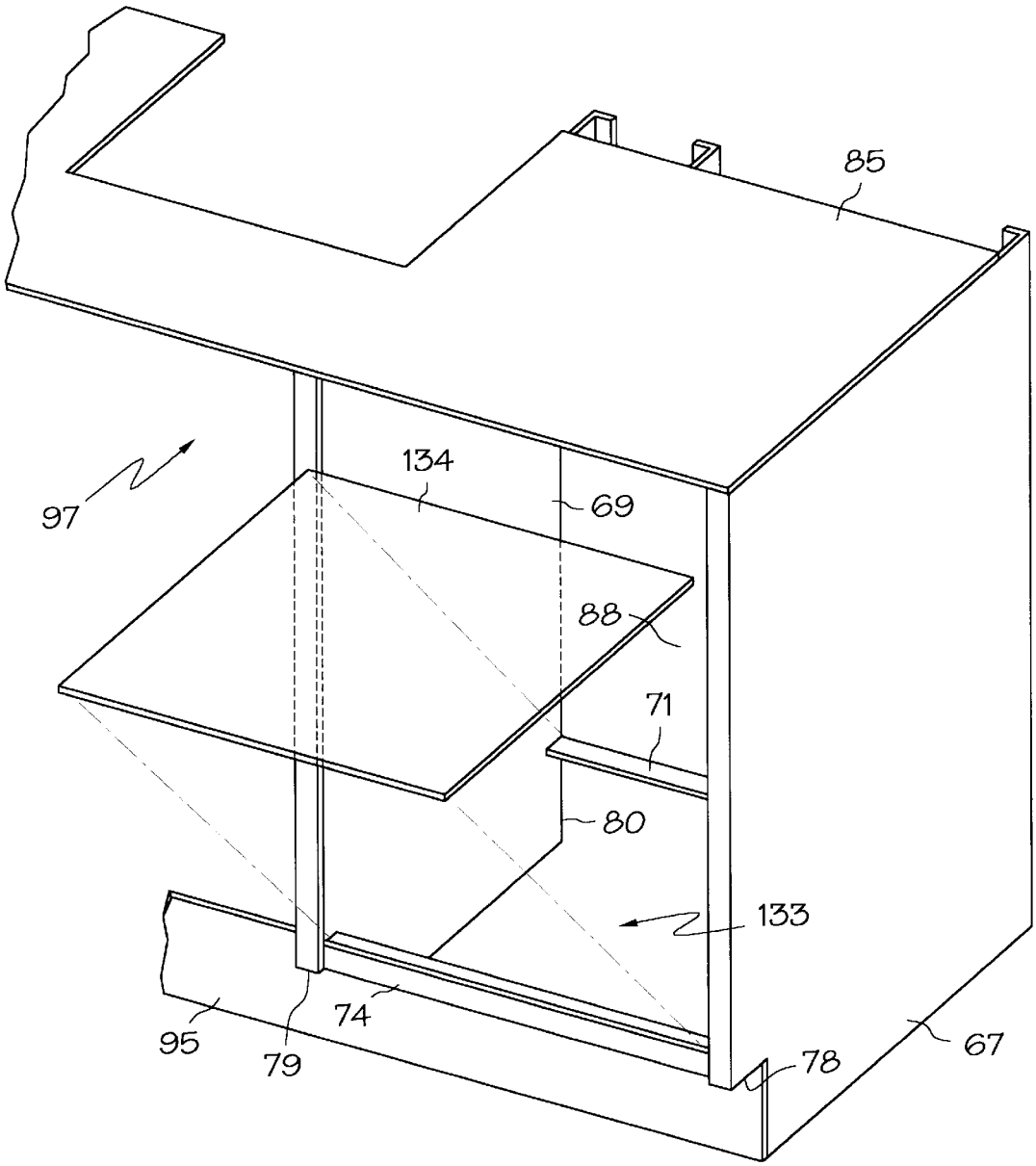
FIG. 12 is a perspective view of the left cabinet portion of the counter assembly of the transaction station.

Each of the side panels 66–69 has a notch provided in its lower-most rear corner (i.e., the lower most corner positioned away from front panel 65). Thus, as shown in FIG. 7, right side panel 66 has a notch 78, while right interior side panel 68 has a corresponding notch 79. These notches provide the necessary toe space for the counter assembly, and a kick plate 95 may be secured within these notches as shown in FIG. 12. In addition, a flange 72 is also provided along the rear edge of the side panels as shown in FIG. 7. As will be more fully understood in conjunction with the description of FIG. 12, flanges 72 along the rear edge of the side panels provide a suitable surface against which doors, drawers, shelf supports and the like may be secured.

Interior side panels 68 and 69 each have lower and upper notches 80 and 81, respectively, along their forward-most edge. As will be more fully described below, upper notches 81 in interior side panels 68 and 69 cooperate with other members to form a heat plenum. Lower notches 80, on the other hand, cooperate with other members of the counter assembly to provide a wire chase. Both the heat plenum and wire chase features will be more fully described below.

Figure 8:
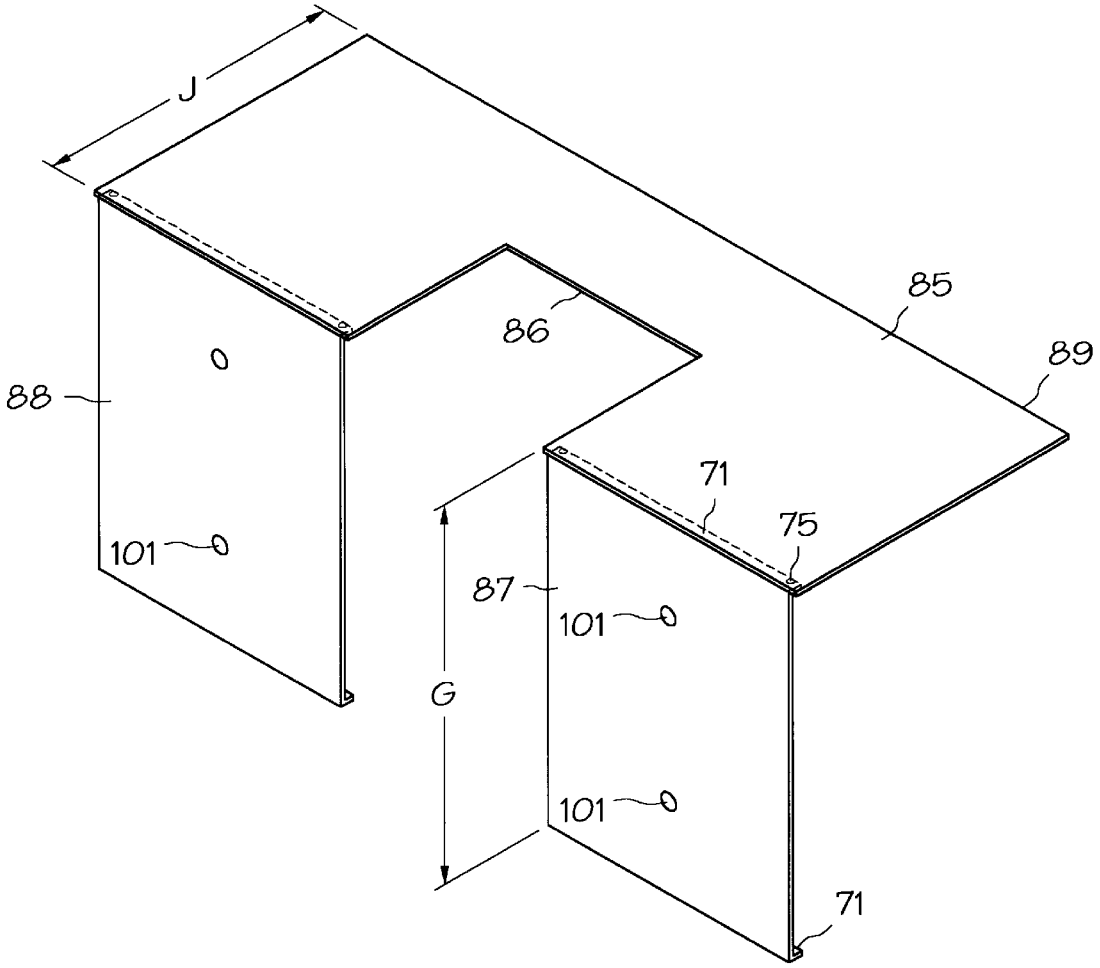
FIG. 8 is a perspective view of another portion of the counter assembly of the transaction station of FIG. 1.

As shown in FIG. 8, the counter assembly further comprises a top panel 85 and right and left interior front panels 87 and 88, respectively. Each interior front panel may comprise a rectangular steel sheet, each having a flange 71 along its upper and lower surfaces. Since the flange along the lower surface of the interior front panel may be employed as a support for a shelf or drawer unit, the lower flange may be wider than that provided along the upper surface. Preferably, the height G of each of the interior front panels corresponds approximately to the distance F (see FIG. 7) between notch 80 and the upper edge of interior side panels 68 and 69. In this manner, interior front panels 87 and 88 will not block access to the wire chase along the lower front edge of the counter assembly.

Top panel 85 is also preferably rectangular, and should have a U-shaped cutout 86 in order to provide access to the transaction drawer. Cutout 86, however, may be of any of a variety of shapes, depending in large part upon the configuration of the transaction drawer. Thus, the U-shaped configuration for cutout 86 shown in FIG. 8 is merely one preferred embodiment. As also shown in FIG. 8, right and left interior front panels 87 and 88 may be riveted to top panel 85 in the manner described previously. The front surface of each interior front panel is preferably flush with the forward-most edge of top panel 85 as shown, and the panels may thereafter be permanently secured to one another by means of spot welding, bolts or other means well known to those skilled in the art.

Figure 9:
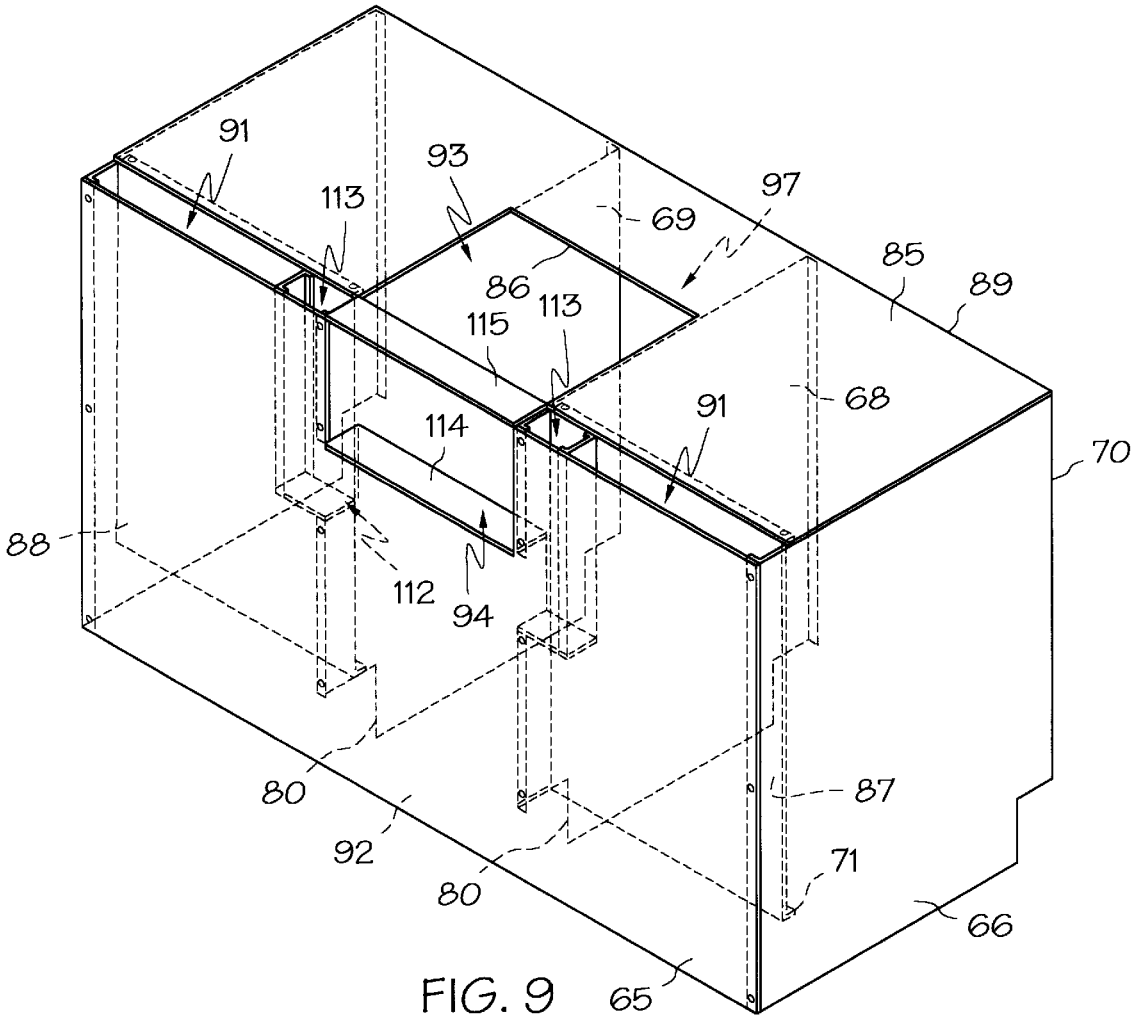
FIG. 9 is a perspective view of the counter assembly of the transaction station, wherein the structures of FIGS. 7 and 8 have been combined with one another.
Figure 10:
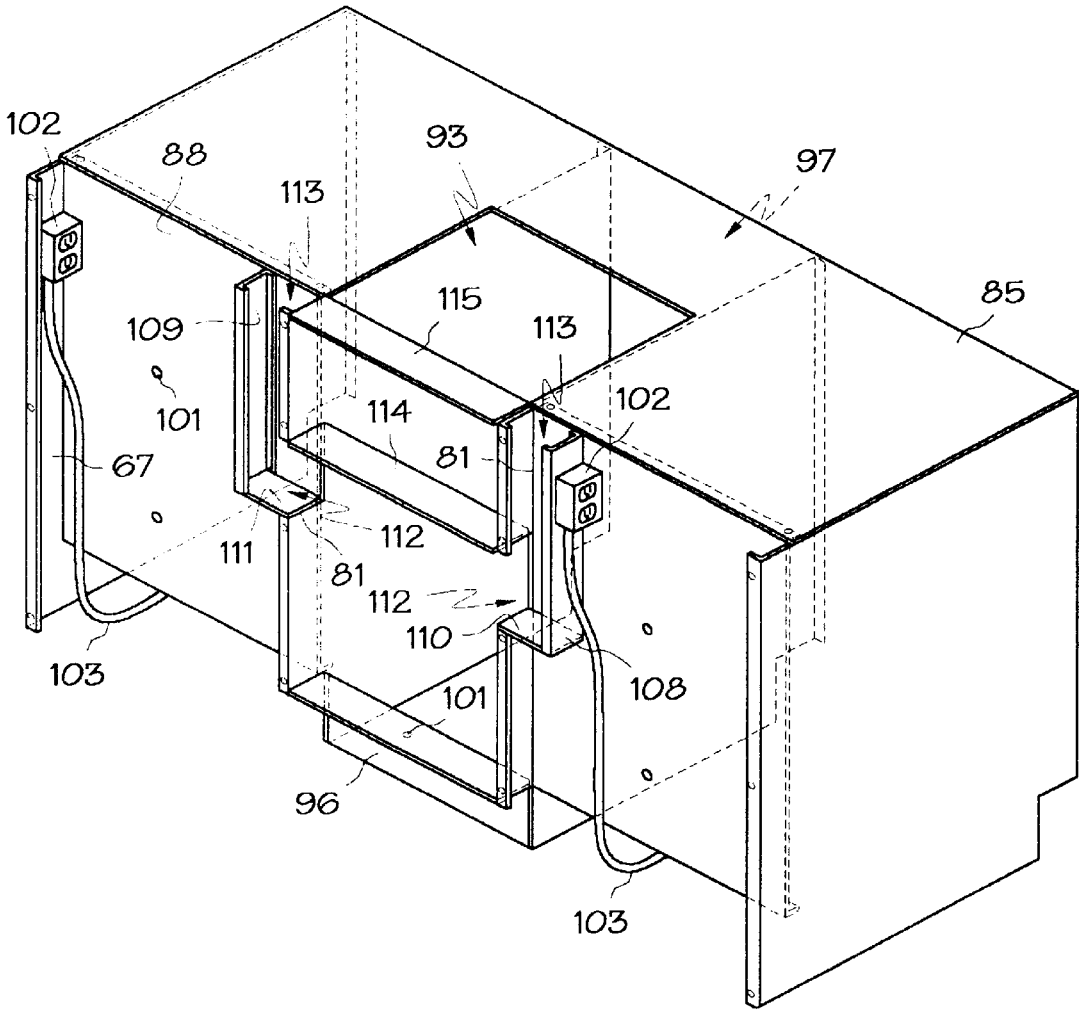
FIG. 10 is a perspective view of the counter assembly shown in FIG. 9, wherein front panel 65 has been removed for purposes of clarity.

In order to complete the monocoque shell of the counter assembly, the structure of FIG. 8 is essentially dropped into the structure of FIG. 7 such that interior front panels 87 and 88 are in a spaced-apart, facing relationship to front panel 65 (as best shown in FIGS. 9 and 10). The region between right and left interior front panels 87 and 88 is generally open from rear edge 89 of top panel 85 to main front panel 65. This area provides a convenient region, identified as 97 in FIG. 9, where an attendant (such as a bank teller) may be seated.

Preferably, the structure of FIG. 8 is positioned within that of FIG. 7 such that the rear-most edge 89 of top panel 85 is positioned flush with the rear-most edge 70 of the side panels. Since the width J of top panel 85 (see FIG. 8) is less than the width H of each of the side panels (see FIG. 7), a pair of gaps 91 between front panel 65 and right and left interior front panels 87 and 88 will be provided. Each gap 91 will extend from top panel 85 to the base of the counter assembly, and communication between gaps 91 on the right and left sides of the counter assembly is provided through notches 80 within region 92.

Once the assembly of FIG. 8 has been dropped into that of FIG. 7, the various panels (i.e., sheets or skins) may be secured to one another by welding, bolting, or other means known to those skilled in the art. Spot welding is preferably employed, and anchoring flanges 71 need not be provided along every panel juncture. For example, right exterior interior front panel 87 may be directly spot welded to the interior surface of right side panel 66 without the need for asupporting flange. Proper alignment is assured by the previous riveting of the panels shown in FIG. 8 to one another. In this manner, the various sheet panels of the counter assembly are self-jigging, and proper alignment is virtually fool-proof.

The transaction station of the present invention is particularly suited for use as a bank teller station, a drive-up window for a restaurant, or even an attendant counter at a gas station. In all of the these applications, electrical connections for various components of not only the transaction station itself, but also other equipment, are required. For example, most transaction stations utilize electronically-operated transaction drawers (also known as "deal drawers") in order to improve security as well as enhance productivity. In addition, these applications also often require the installation of an audio system so that the attendant can communicate with customers. Other electronic devices such as lights, heaters, security systems and various countertop appliances also require electrical power. In the prior art transaction stations, however, a simple means for routing all of these electrical cables was generally not provided. In addition, in many installations, the master power supply provided by the building to the transaction station is generally not positioned in a consistent or convenient location. Thus, there is also a need for a transaction station which can readily be connected to a power source located in a variety of positions with respect to the station itself. In addition, safe, organized, and aesthetically-pleasing routing of the various electronic cables and other connecting devices is desired. Thus, the modular transaction station of the present invention provides an integral wire chase, as well as various passageways which provide access to the wire chase.

As mentioned above, the right and left interior front panels 87 and 88, respectively, are positioned within the counter assembly such that a pair of gaps 91 are provided between these interior front panels and main front panel 65. A gap 91 extends in front of each of right and left interior front panels 87 and 88, as best shown in FIG. 9. Although the interior side panels 68 and 69 extend completely to main front panel 65, lower most front notches 80 on each of the interior side panels allows region 92 at the front lower most edge of the counter assembly to provide the necessary communication between gaps 91 located along either side of the front of the counter assembly. In this manner, a generally U-shaped wire chase is provided at the front of the counter assembly. This U-shaped wire chase is formed by region 92 extending across the lower front of the counter assembly, and each of the two gaps 91 which extend upwardly away from the lower front portion of the assembly along either side of open region 97. Both of gaps 91 are accessible at the top of the counter adjacent to the front edge of top panel 85, thereby providing countertop access to the wire chase. In addition, since right and left interior front panels 87 and 88 do not extend completely to the base of the counter assembly, access to the wire chase is also provided beneath these interior front panels (beneath flange 71). Access to the wire chase in this manner is best shown in FIG. 12 by the region positioned directly beneath flange 71 on left interior front panel 88. Access to the wire chase may also be obtained at the lower, forward-most portion of open region 97 (i.e., at region 92 shown in FIG. 9). In addition, one or more apertures 101 may be provided in right and left interior front panels 87 and 88, as shown in FIG. 8. Electrical cords, cables and the like may extend from the wire chase through apertures 101 into the interior of the counter assembly. Similar apertures may be provided in front panel 92, or any other panel, as needed.

One particular use of the wire chase is shown in FIG. 10 wherein a pair of electrical outlets 102 are provided. One of outlets 102 is secured to the interior of left side panel 67 within the wire chase. Similarly, a second electrical outlet 102 is mounted to right vertical plenum wall 108, which is more fully described below. A power cable 103 extends from each electrical outlet 102, and is preferably connected to a power source (such as the electrical system of the building within which the transaction station is to be placed). By way of example, power cables 103 may be routed beneath interior front panels 87 and 88, and thereafter connected to an electrical outlet in the floor of the building. Various electrical devices may then be powered by connecting them to electrical outlets 102. In addition, power cables for an electronic transaction drawer, audio system, or other electrical componentry of the transaction station may likewise be powered by merely connecting such devices to one of electrical outlets 102 or the power supply for the building. Multiple electrical outlets 102 may be provided as needed, and the number and location shown in FIG. 10 is merely exemplary of a preferred embodiment. Access to electrical outlets 102 may be obtained through any of the means previously described, such as beneath interior front panels 87 and 88, through apertures 101, or even through the top entry to gaps 91 adjacent the front edge of top panel 85.

Although access to the wire chase may be obtained at the front, lower-most portion of central open region 97 (at 92), after the necessary electrical cables and other wiring has been put in place, it is preferred that a wire chase cover 96 be installed. As shown in FIG. 10, wire chase cover 96 essentially comprises an "L"-shaped plate having cross-sectional dimensions which correspond substantially to that of notches 80 in interior side panels 68 and 69. In this manner, wire chase cover 96 will block access to the wire chase from within central open region 97, while not blocking the communication between the right and left portions of the wire chase via region 92. Use of wire chase cover 96 will often be desired, since it will prevent an attendant seated at the counter assembly from accidentally kicking any wires which extend through region 92 of the wire chase.

Since the transaction station of the present invention is intended primarily for installation in an exterior wall of a building, it will often be subjected to varying temperatures and humidities. Often, the temperature and humidity within the interior of the building will differ considerably from that on the outside, and the installation of a movable transaction drawer in the station of the present invention will provide a continual exchange of these differing atmospheres. The result may be fogging of the window positioned above the counter, and/or discomfort for an attendant seated behind the counter within the building. This is particularly true when the air outside of the building is considerably colder than the air inside. In order to alleviate these problems, the transaction station of the present invention further features an air or heat plenum through which conditioned air may be passed. It should be noted that although this is referred to as a "heat" plenum, cooled air may also be passed therethrough if desired. More typically, however, heated air will be passed through the heat plenum in order to allow warmed air to be directed at the window of the transaction station in order to prevent fogging. Additionally, or alternatively, heated air may be directed from the plenum to other regions of the transaction station in order to improve the comfort of an attendant (such as a bank teller) positioned behind the counter.

As best shown in FIG. 10, wherein front panel 65 has been removed for purposes of clarity, right and left vertical plenum walls 108 and 109, respectively, are provided. Each vertical plenum wall comprises a rectangular panel having a flange formed along each vertical edge thereof. It should be pointed out, that plenum walls 108 and 109 need not be vertical, as any of a variety of configurations may be employed in order to form a heat plenum, with the only requirement being that the plenum walls act to isolate a region between interior front panels 87 and 88, and front panel 65.

Preferably, right and left vertical plenum walls 108 and 109 extend from top panel 85 downwardly to a point parallel with the lower most edges of notches 81 in right and left interior side panel 68 and 69. In order to complete the air or heat plenum, right and left plenum base portions 110 and 111 extend from the lower-most edge of their respective vertical plenum walls to the lower-most edge of notches 81 as shown. In this manner, when front panel 65 is in place, heat plenums will extend downwardly along the front portion of each of interior side panels 68 and 69. Access to these two heat plenums is provided by lower entries 112, and upper openings 113. Thus, if heated air is directed through lower entries 112, it will thereafter exit through upper openings 113. The use of heated air exiting through openings 113 is discussed more fully herein below.

Heated air may be directed to the plenums by a variety of means. One such embodiment is shown in FIG. 14, wherein a heater assembly 119 is provided. Any type of heater assembly may be employed, such as a combination of one or more electrical resistance elements and a fan for forcing heated air through the air plenum. In the example shown, heater assembly 119 generally comprises a pair of finned strip heaters 124 along with a fan 125. Heaters 124 and fan 125 may be secured to a heater access panel 123 as shown. A portion of heater access panel 123 has a plurality of apertures 131 which may be provided in a grid pattern as shown. Air may be drawn through apertures 131 by means of fan 125 and then blown across heaters 124, thereby heating the air.

As further shown in FIG. 14, heater access panel 123 generally comprises a front plate 146 having apertures 131 therethrough, and lower and upper flanges 147 and 148, respectively. Lower and upper flanges 147 and 148 preferably extend perpendicularly away from front plate 146 so as to at least partially overlie heaters 124 and fan 125. A lip 149 also preferably extends downwardly away from lower flange 147 as shown.

A control panel cover 121 is also provided in conjunction with heater assembly 119, and may be positioned atop heater access panel 123. Cover 121 may be attached to panel 123 by any of a variety of means, including welding, bolts or screws. It is preferred, however, that cover 121 be attached to panel 123 in a non-permanent manner (e.g., by screws) such that it may be easily removed to facilitate maintenance or repair of the heater assembly and its accompanying control systems. Control panel cover 121 may comprise a rear plate 150, and upper and lower flanges 151 and 152, respectively, which extend perpendicularly away from rear plate 150. A control system for heater assembly 119 may be positioned beneath upper flange 151 against rear plate 150, and thus control panel cover 121 provides a convenient enclosure. Of course if desired a more enclosed structure for a control system may be provided in place of cover 121. One or more apertures 122 may also be provided in upper flange for passage of electrical cables or other components of the heater control system.

Figure 15:
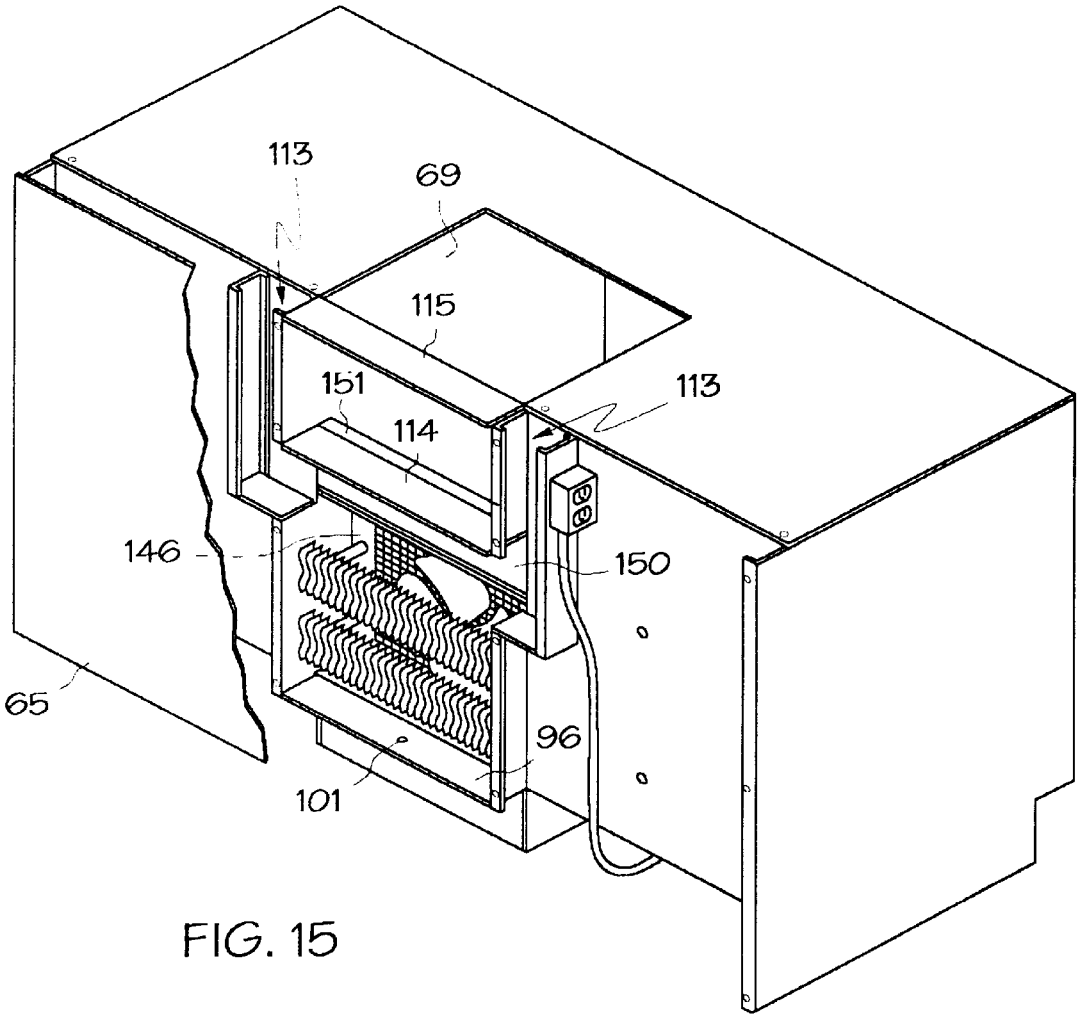
FIG. 15 is a perspective, partially cut-away view of the counter assembly, with the heater assembly and wire chase cover installed.

Although any of a variety of heating units may be employed for directing heated air into the heat plenums, the use of heater assembly 119, and accompanying heater access panel 123 and control panel cover 121, is advantageous in that a unitary heat plenum is provided. As best shown in FIG. 15, a support plate 114 extends between interior side panels 68 and 69 immediately above notches 81 therein. Support plate 114 may comprise a rectangular panel (preferably sheet steel) which is secured to the interior side panels by means of welding, or other means known to those skilled in the art. Heater assembly 119, and accompanying heater access panel 123 and control panel cover 121, may then be installed directly beneath support plate 114, thereby completing the unitary air plenum. Panel 123 and cover 121 will extend across their widths between interior side panels 68 and 69, and lengthwise between the rear most edge of support plate 114 and wire chase cover 96. Specifically, lip 149 of heater access panel 123 extends across the width of wire chase cover 96 and may be secured thereto. Likewise, rear plate 150 of control panel cover 121 may be secured to the rear edge of support plate 114. Since the widths of both heater access panel 123 and control panel cover 121 preferably correspond to the distance between interior side panels 68 and 69, a unitary air or heat plenum is provided, with upper openings 113 providing communication between the ambient and the interior of the heat plenum. Thus, this unitary heat plenum comprises the rectangular volume bounded by support plate 114, wire chase cover 96, front panel 65 and rear plate 150 and front plate 146, as well as the pair of vertically extending channels or passageways which form the dual heat plenums described in conjunction with FIG. 10. Air will be directed across heaters 124, and is then forced upwardly through the heat plenum so as to exit through openings 113. Power to the heater assembly may be provided via a power cord extending through aperture 101 in wire chase cover 96, and thereafter to either one of electrical outlets 102 (or another power source provided by the building).

Panel 123 and cover 121, and in turn heater assembly 119 attached to panel 123, may be secured to the counter assembly by a variety of well-known means (welding, bolting, screws, etc.). It is preferred, however, that the means for attachment be non-permanent in order to allow ready access to the internal components of the heater assembly. Thus, lip 149 of heater access panel 123 may be bolted or screwed to wire chase cover 96, and rear plate 150 of control panel cover 121 similarly attached to support plate 114.

While the heater assembly and accompanying panel and cover described above are presently preferred, any rigid panel may be positioned in the same manner in order to provide the unitary air plenum. For example, control panel cover 121 may be eliminated and the length of heater access panel 123 increased so as to extend between the rear most edge of support plate 114 and wire chase cover 96. Any of a variety of means may then be employed to direct conditioned (e.g., warmed) air upwardly in the air plenum so as to exit through upper openings 113. For example, a fan may draw air into the plenum wherein it is heated by any of a variety of means, and thereafter directed upwardly in the plenum (as described above). Alternatively, hoses or similar devices may force conditioned air into the plenum and thereafter through openings 113.

Regardless of the type of heater assembly employed, however, it is preferred that a control system be provided to ensure adequate control of the temperature of the air exiting the plenum, and optionally the rate of air flow. In the embodiment of FIGS. 14 and 15, a conventional control system may be positioned beneath top flange 151 of control panel cover 121, as described previously. This control system may be readily constructed by those skilled in the art, and need not be described in detail. It is preferred, however, that separate controls for the fan and heaters be provided, including an ability to adjust the temperature of the air leaving the plenum. The control system should also ensure the longevity of the heater assembly, such as by ensuring that the fan will continue to run until the heaters reach a certain minimum temperature in order to prolong the life of finned heaters 124.

Since the transaction station of the present invention is intended to be used to complete various types of transactions between a customer on one side of a wall and an attendant located on the other side, a transaction drawer (also referred to as a "deal drawer") is also provided. As shown in FIG. 1, wherein the face plate 126 of the drawer assembly is shown, the drawer is preferably positioned in the center portion of the transaction station immediately below central transom 30. The transaction drawer should also be positioned such that when it is in its retracted position (as shown in FIG. 1), access to the interior of the drawer may be obtained through the central opening 93 provided by cutout 86 in top panel 85 (FIG. 9). When the transaction drawer is extended away from the interior of the cabinet assembly, face plate 126 will move away from the front surface of the transaction station in order to allow the customer to access the interior of the drawer. As is well-known in the art, a drawer cover 130 (see FIG. 1) may also be attached to either the drawer assembly or top panel 85.

As previously mentioned, support plate 114 extends between interior side panels 68 and 69 and acts to further define the heat plenum of the counter assembly. In addition, plate 114 also provides support for the drawer assembly and, together with upper support plate 115 and interior side panels 68 and 69, defines a rectangular opening 94 for the drawer assembly (see FIG. 9). Support plate 115 (which preferably comprises a steel sheet) also provides further structural integrity in the area of central opening 93, which is provided by cutout portion 86 in top panel 85. Support plates 114 and 115, together with interior side walls 68 and 69, define rectangular opening 94 through which the drawer assembly may move between its extended and retracted positions, and will further assist in proper location of the drawer assembly.

Figure 16:
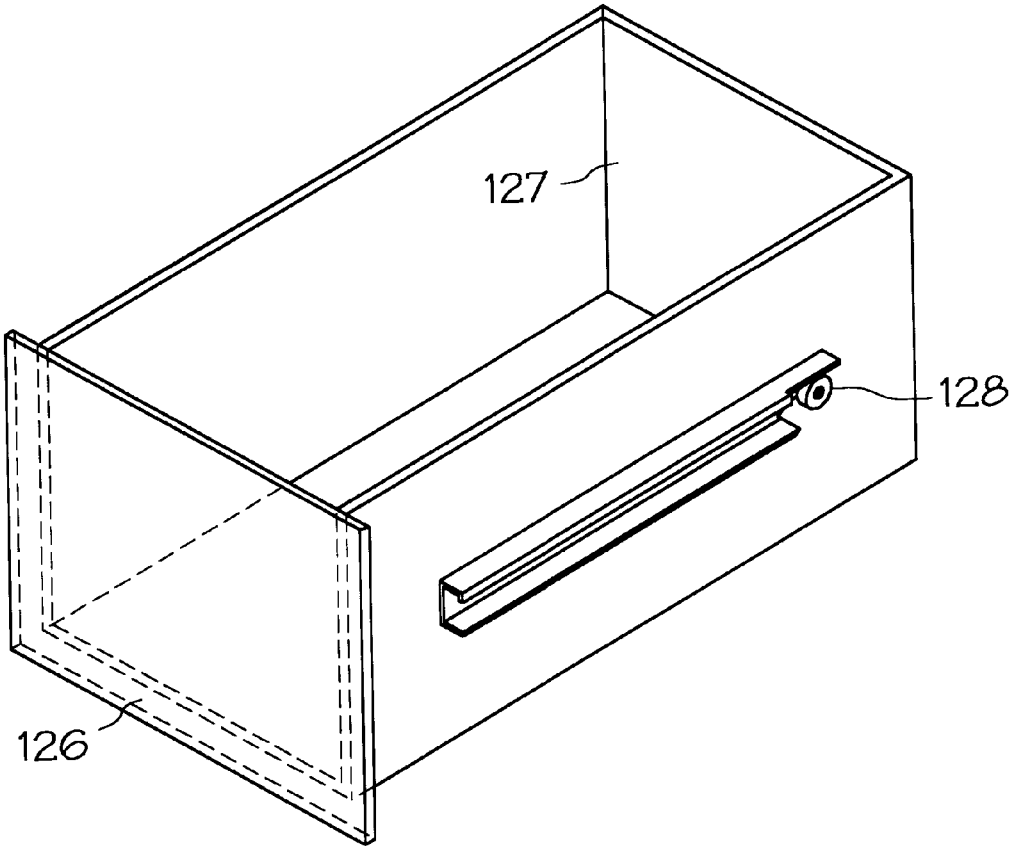
FIG. 16 is a perspective view of one embodiment for a drawer assembly which may be employed in the modular transaction station of the present invention.

The drawer assembly itself can be of any of a variety of configurations and complexities. A simple embodiment for this drawer is shown in FIG. 16, wherein this assembly comprises a drawer 127 having a rectangular face plate 126 secured thereto. Preferably, face plate 126 is slightly larger than the end wall of drawer 127 such that face plate 126 will not only prevent over-retraction of the drawer, but also to provide a more aesthetically-pleasing appearance as shown in FIG. 1. In addition, face plate 126 is preferably larger than the rectangular opening provided between support plates 114 and 115 and interior side panels 68 and 69, thereby preventing access to the interior of the counter assembly from the external side of the transaction station when the drawer is in its retracted position.

Figure 11:
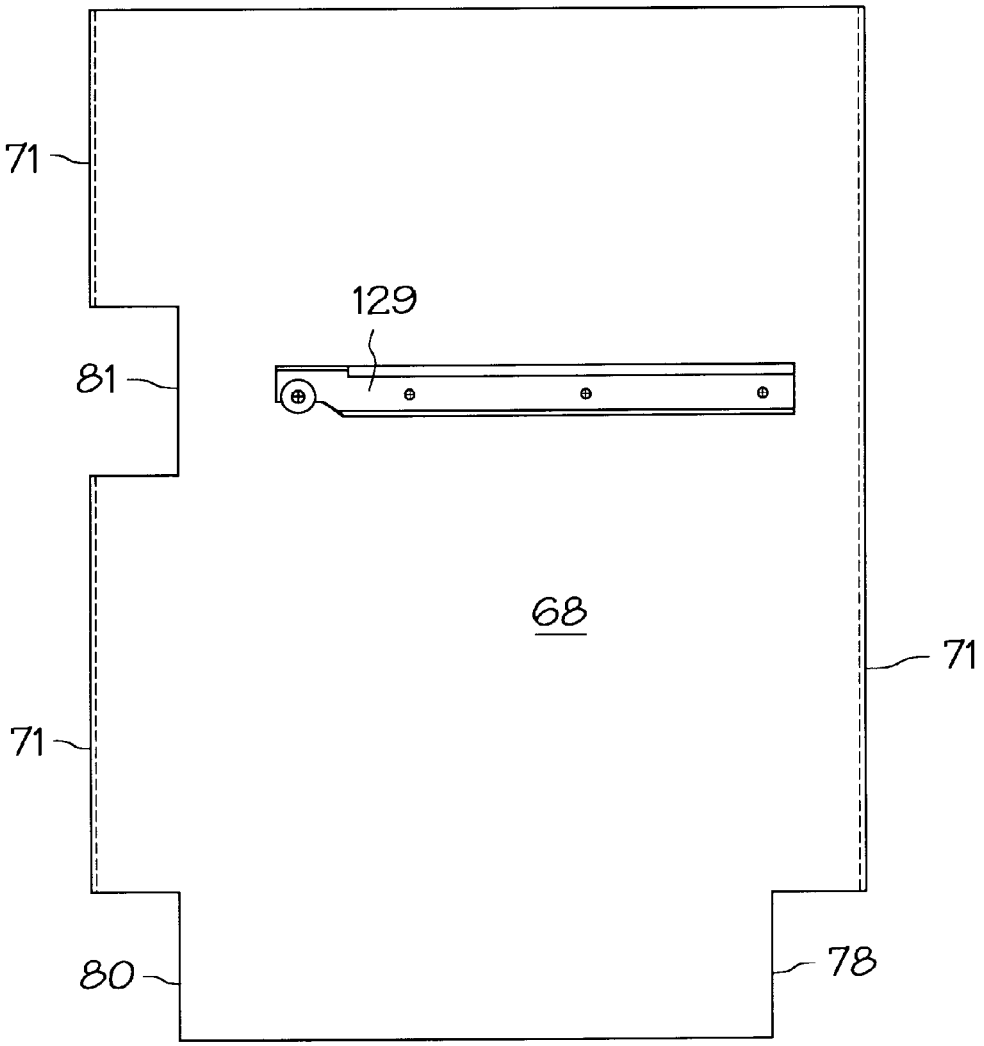
FIG. 11 is a side plan view of right interior side panel 68.

In order that the drawer assembly be movable between extended and retracted positions, conventional track assemblies 128 may be secured along either side of drawer 127. Corresponding roller or guide assemblies 129 may then be secured to interior side panels 68 and 69 (see FIG. 11) such that the drawer assembly will be movable between its extended and retracted positions. Guide assemblies 129 should be secured to the interior side panels such that drawer 127 will freely will move within rectangular opening 94 provided between support plates 114 and 115 (see FIG. 9). The roller and track assemblies provided on the drawer assembly of FIG. 16 may be of any variety well-known to those skilled in the art, including the type found in conventional cabinetry. Thus, the configuration shown is but merely one simple embodiment.

Alternatively, and as presently preferred, the transaction drawer assembly of application Ser. No. 08/582,094, filed Jan. 2, 1996 (which is incorporated herein by reference), is employed in the transaction station of the present invention. The drawer housing of the drawer assembly shown in this application may be readily secured to interior side panels 68 and 69, as well as support plates 114 and 115. Of course any of a variety of other types of transaction drawers may be employed in the transaction station of the present invention.

Once the drawer assembly has been installed, it will be apparent that the heat plenum is located immediately below the front portion of the drawer assembly, and extends upwardly along either side thereof. The wire chase of the transaction station, on the other hand, extends directly beneath the heat plenum, and upwardly along either side of the heat plenum (a generally "U"-shaped configuration). Any power cables and other wiring necessary to operate the transaction drawer may be routed into and through the wire chase in the manner described previously, or even through the interior of the frame members.

As mentioned previously, the counter assembly of the present invention has a central region 97 which will accommodate a seated or standing attendant (such as a bank teller). The regions to the right and left of this central region, however, essentially comprise a pair of cabinets bounded by top panel 85, the interior and exterior side panels, and the interior front panels. In FIG. 12, wherein the counter assembly is viewed from the rear, a left cabinet portion 133 of the counter assembly is depicted. Left counter assembly 133 is bounded by top panel 85, left exterior side panel 67, left interior side panel 69 and left interior front panel 88. Within the interior of left cabinet portion 133, any of a variety of features may be provided (e.g., stationary or sliding shelves, drawers, lockable doors, etc.). Thus, in the embodiment shown in FIG. 12, a shelf 134 may be positioned atop flange 71 of left interior front panel 88, and support plate 74 which has been secured to left side panel 67 and left interior side panel 69 at notches 78 and 79 therein. If desired, additional shelving may be positioned within cabinet 133, as needed, by any of a variety of means well-known to those skilled in the art. Conventional shelf support rails, for example, may be secured to outer side panel 67, interior side panel 69, and/or interior front panel 88. If desired, an access door, including one that is lockable, may also be secured at the front of left cabinet 133. Similar features (such as shelving and a door) may likewise be provided in the right cabinet portion of the counter assembly which is located on the side of central opening 97 opposite that of left cabinet portion 133.

In order to provide a smooth, durable and aesthetically-pleasing work surface, countertop 90 (shown in FIG. 13) is further provided. Countertop 90 may comprise any of a variety of materials commonly employed for countertops and desk surfaces, including wood, plastic, metal and various combinations thereof. One particularly preferred material is particle board upon which plastic laminate has been applied in order to provide a smooth and durable work surface. Countertop 90 is preferably rectangular, and has a width approximately equal to width H of right and left exterior side panels 66 and 67 (see FIG. 7). The length of countertop 90 preferably is equivalent to the length of front panel 65. In this manner, countertop 90 may be simply secured atop the counter assembly shown in FIG. 9 such that the periphery of countertop 90 will be positioned flush with the outer edges of the entire counter assembly of FIG. 9. A rectangular cutout 136, preferably corresponding in dimensions to central opening 93 in top panel 85, is also provided in countertop 90. In this manner, access to the interior of drawer 127 when the drawer assembly is in its retracted position may be obtained through cutout 136.

A pair of apertures 138 are also provided along the front edge of countertop 90. When countertop 90 is properly positioned atop the counter assembly, apertures 138 will be positioned directly above upper openings 113 which provide access to the heat plenum(s). Heated air from the air plenum will thus escape through apertures 138. Various mechanisms may be employed to direct the heated or conditioned air escaping through apertures 138 to the desired location (e.g., towards the window and/or towards a bank teller). One such mechanism is shown in FIG. 1, wherein a pair of circular heat diffusers 155, each having a plurality of vanes therein, are positioned within apertures 138. Diffusers 155 may be rotated so as to direct air escaping from the heat plenum(s) to the desired location (such as against the window). Alternatively, countertop 90 may have a plurality of passageways formed therein which communicate with upper openings 113 when the countertop is in place. These passageways in countertop 90 will then direct heated air to any desired location in the countertop, or even simply circulate the air within the countertop itself so as to provide a heated surface.

Figure 18:
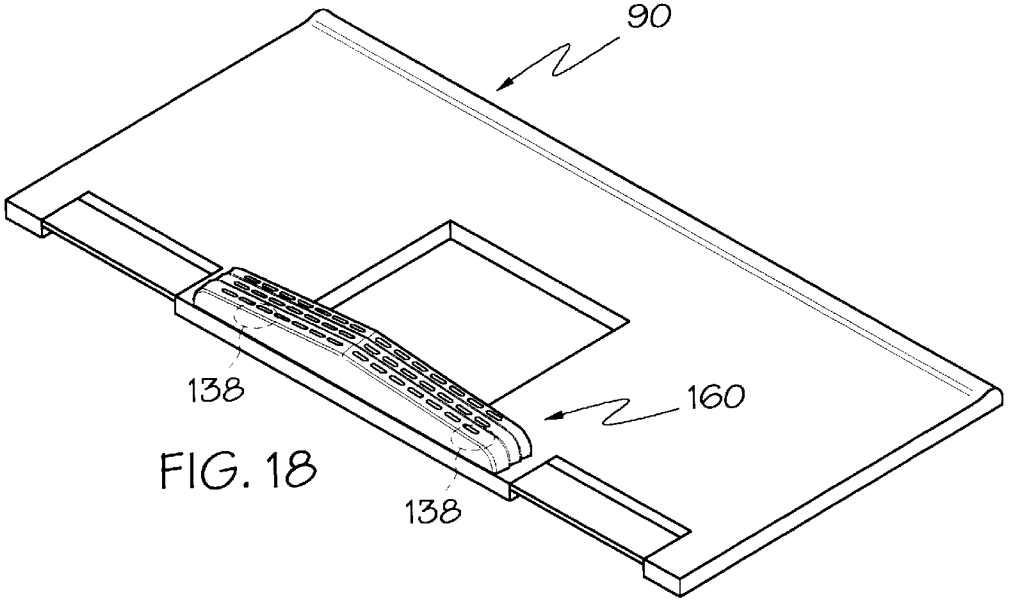
FIG. 18 is a perspective view of an alternative embodiment of the countertop assembly.
Figure 19:
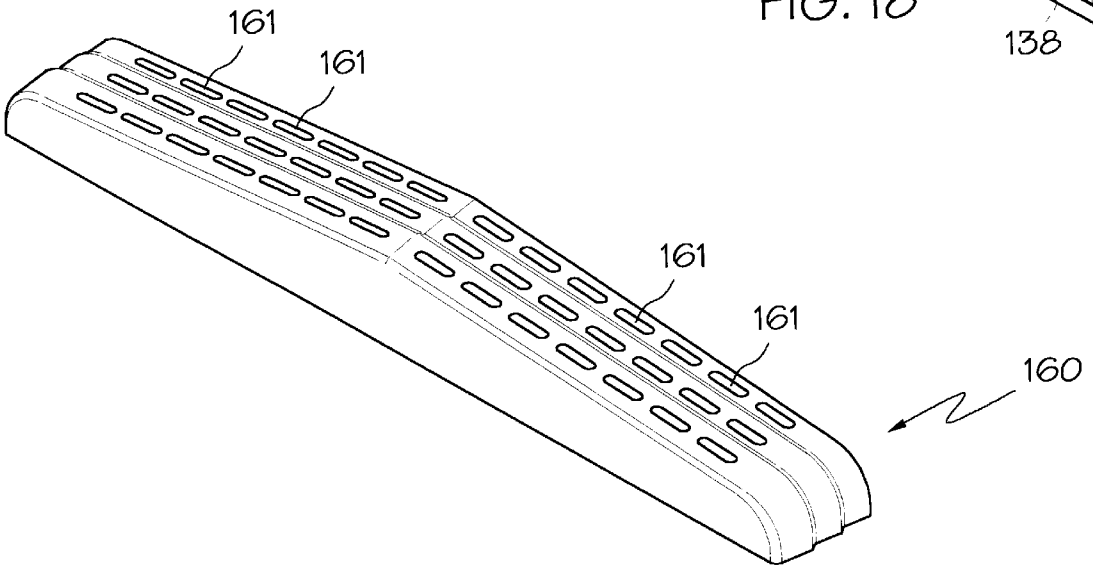
FIG. 19 is a perspective view of the air diffuser shown in FIG. 18.

FIGS. 18 and 19 depict yet another alternative, and presently preferred embodiment for directing and controlling conditioned air escaping from the air plenum. In this embodiment, a single hollow diffuser 160 is positioned across the front edge of countertop 90. Diffuser 160 is preferably hollow such that air exiting apertures 138 will fill the interior of diffuser 160. The top surface of diffuser is preferably tiered such that a plurality of angled surfaces are provided (three in the embodiment of FIG. 19), and each of these tiers are preferably angled towards the front of countertop 90. A plurality of slits 161 are provided in each of the tiers such that the conditioned air will be expelled therethrough. The preferred angling of the tiers of diffuser 160 will ensure that the expelled air is directed towards the window 60 of the transaction station (described below). Of course diffuser 160 may be configured in any of a variety of manners so as to direct the expelled air in the desired direction. Since diffuser 160 has a larger interior volume than the diffusers 155 of FIG. 1, as well as a greater number of apertures through which the air is expelled, the velocity of air exiting diffuser 160 will be significantly reduced. This ensures that the expelled air will not interfere with the use of the transaction station (such as the blowing of papers and the like atop countertop 90.

Figure 13:
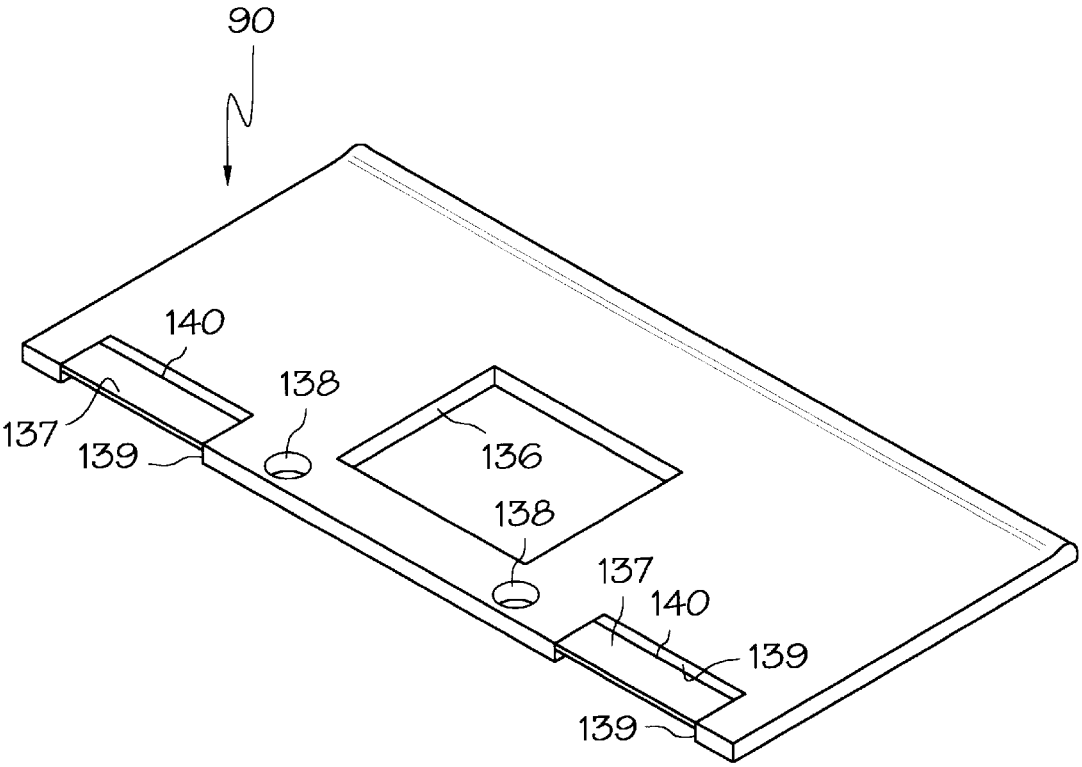
FIG. 13 is a perspective view of the one embodiment of the countertop for the transaction station.

Also provided along the front edge of countertop 90 are a pair of rectangular cutouts 139 (FIG. 13). When countertop 90 is in place, cutouts 139 will correspond substantially with gaps 91 which provide access to the wire chase of the counter assembly. In this manner, wires, power cables and the like may be routed through rectangular cutouts 139 into the wire chase. For example, desktop electrical devices may be powered by connecting a power cable for the device to one of electrical outlets 102. In order to provide a cleaner appearance and safer work surface, a pair of removable access panels 137 may also be provided. Access panels 137 act to block at least a portion of rectangular cutouts 139, thereby limiting access to the wire chase as needed. Since access panels 137 are preferably not as wide as rectangular openings 139, even when access panels 137 are in place, a small opening 140 will nevertheless be maintained, thereby allowing thin electrical cords to pass therethrough into the wire chase. It should also be noted that access panels 137 are preferably thinner than countertop 90, since access panels 137 should be easily removed. Access panels 137 may be held in place within rectangular openings 139 by providing a rabbeted inner surface in openings 139. Finally, countertop 90 may be secured to the counter assembly by any of a variety of means well known to those skilled in the art (e.g., bolting, screws, or even adhesives).

In order to complete the construction of the transaction station, the counter assembly is secured to frame 23 as shown in FIG. 17. As mentioned previously, this may be accomplished by any of a variety of means, however, it is preferred that angle brackets 76 have been omitted from FIG. 9 for purposes of clarity.

Since front panel 65 preferably comprises thin gauge steel, it will usually be necessary to provide one or more front cover panels which overlie front panel 65. These front cover panels will provide further protection for the counter assembly, as well as additional insulation. Particularly in the case of bank teller windows, these front cover panels will often be necessary in order to provide the required bullet resistance. Thus, as shown in FIG. 17, a plurality of front cover panels 141, 142, 143 and 144 are provided. Each is preferably rectangular in shape, corresponding in dimension to lower opening 36 in frame assembly 23 (see FIG. 2). Since the counter assembly is preferably attached to the frame members such that only the angle brackets 76 are positioned within lower opening 36, it will be apparent that the front cover panels will be slightly smaller than front panel 65 of the counter assembly. A rectangular cutout should also be provided in each of the front cover panels such that when the cover panels are in place, these rectangular cutouts will correspond with rectangular opening 94 in the counter assembly which accommodates the transaction drawer (see FIG. 9). One or more of the front cover panels may also have additional cutouts or openings therein in order to provide a location for external features such as speaker 28. Thus, as shown in FIG. 17, outer-most front cover panel 144 has a rectangular speaker opening 145. One or more of the other front cover panels 141–143 may also have similar speaker openings therein in order to accommodate speaker 28. Additionally, one or more of the front cover panels may have a channel therein in order to allow for internal routing of wiring to speaker 28.

A variety of materials may be employed for each of the front cover panels, depending upon the needs of the particular installation. In a preferred embodiment, front cover panel 141 comprises a layer of foam insulation, cover panel 142 comprises a masonite sheet, cover panel 143 comprises an additional foam insulation layer and outermost front cover panel 144 comprises aluminum. Other materials may be employed in order to provide additional bullet resistance, insulation or other protective features, as needed. Each of the front cover panels may be secured within lower half 36 of frame 23 by any of a variety of means including adhesives, welding, fasteners, and the like.

Finally, one or more panes of glass 60 are provided in upper opening 35 of frame 23 (see FIGS. 1 and 2). Various thicknesses and types of glass may be employed, depending upon the degree of protection, insulation, glare reduction, and light transmission desired. Preferably, the angle glazes glass is installed such that the glass is tilted slightly (preferably about two degrees) in order to reduce glare. Clear plastic may even be employed instead of glass panes. If the transaction station is to be used as a bank teller window, it is preferred that multiple panes of glass 60 be employed, and that these panes provide the necessary degree of bullet resistance, as is well-known in the art, Glass pane(s) 60 may be secured within upper opening 35 by conventional means. Thus, as best shown in FIG. 4, wherein a single pane of glass 60 is used, a conventional glass frame 61 is provided. Glass frame 61 extends about the entire periphery of glass pane 60, and may be secured within upper opening 35 of frame 23 by conventional means well-known to those skilled in the art. Various other types of glass supports may be used, and thus glass frame 61 pictured in FIG. 4 is merely one exemplary embodiment.

The foregoing description of preferred embodiments is by known means exhaustive of each and every variation of the present invention which is possible, and has therefore only been presented for purposes of illustration and description. Modifications and variations in the above-described embodiments will be apparent to those skilled in the art in light of the teachings herein, and these modifications and variations are all within the scope of the present invention. For example, although the counter assembly has been described as being formed from thin gauge sheet steel, various other materials may be employed without departing from the scope of the present invention. In addition, the transaction station of the present invention may be used for any of a variety of purposes, in addition to bank teller windows. Thus, it is intended that the scope of the present invention be defined by the claims appended hereto, and not by the specific embodiments shown in the drawings or described above.

What I claim is:

1. A modular transaction station, comprising:

(a) a frame;

(b) a counter assembly secured to said frame; and (c) first and second mounting sleeves extending about at least a portion of the periphery of said frame, said first mounting sleeve secured to said frame, and said second mounting sleeve adjustably securable to at least one of said frame and said first mounting sleeve;

wherein said transaction station may be secured within an opening in a wall such that a portion of a wall bounding the opening is securely held between said first and second mounting sleeves.

2. The modular transaction station of claim 1, wherein:

said first mounting sleeve is adjustably secured to at least a portion of the periphery of said frame; and said second mounting sleeve is adjustably securable to said first mounting sleeve, such that said second mounting sleeve may be secured to said first mounting sleeve a variable distance from said first mounting sleeve.

3. The modular transaction station of claim 1, wherein:

said first and second mounting sleeves each have face portions which extend away from said frame; and said second mounting sleeve is securable to at least one of said first mounting sleeve and said frame, such that said transaction station may be secured within an opening in a wall by securing a portion of the wall bounding the opening between said face portions.

4. The modular transaction station of claim 3, wherein said first mounting sleeve has a side panel which extends substantially perpendicularly away from said face portion of said first mounting sleeve, and wherein the side panel of said first mounting sleeve is secured about a portion of the periphery of said frame.

5. The modular transaction station of claim 1, further comprising a plurality of threaded members extending away from at least one of said first mounting sleeve and said frame, and wherein said second mounting sleeve has a plurality of threaded fasteners positioned about said second mounting sleeve, wherein said second mounting sleeve may be adjustably secured to at least one of said first mounting sleeve and said frame by threadably securing said threaded members to said threaded fasteners.

6. The modular transaction station of claim 1, wherein said counter assembly comprises a plurality of rigid panels joined to one another so as to provide a substantially monocoque structure.

7. The modular transaction station of claim 1, wherein said counter assembly has an air plenum therein, through which air may be directed.

8. The modular transaction station of claim 7, further comprising a heater assembly for directing heated air through said air plenum.

9. The modular transaction station of claim 7, wherein said counter assembly has a wire chase extending through a portion thereof, wherein electrical wiring may be routed through said wire chase.

10. The modular transaction station of claim 8, wherein said counter assembly has a top surface and a transaction drawer moveable between extended and retracted positions, and wherein said air plenum extends upwardly adjacent at least one side of said transaction drawer within said counter assembly such that heated air may be directed upwardly through said air plenum and thereafter expelled away from the top surface of said counter assembly.

11. A modular transaction station, comprising:

(a) a frame having upper and lower portions, wherein said frame may be positioned within an opening in a structure;

(b) a counter assembly attached to the lower portion of said frame; and (d) an air plenum within said counter assembly through which air may be directed.

12. The modular transaction station of claim 11, wherein said counter assembly comprises a plurality of rigid panels joined to one another so as to provide a substantially monocoque structure.

13. The modular transaction station of claim 11, wherein said counter assembly has a wire chase extending through a portion thereof, wherein electrical wiring may be routed through said wire chase.

14. The modular transaction station of claim 11, wherein said counter assembly has a transaction drawer moveable between extended and retracted positions, and wherein said air plenum extends upwardly adjacent at least one side of said transaction drawer within said counter assembly such that air may be directed from the interior of the counter assembly away from said counter assembly.

15. The modular transaction station of claim 11, wherein said counter assembly further comprises a top panel having at least one aperture in communication with said air plenum, such that air may be expelled from said plenum through said at least one aperture.

16. The modular transaction station of claim 15, further comprising an air diffuser positioned above said aperture, said diffuser configured so as to direct the flow of air expelled from said plenum through said aperture.

17. The modular transaction station of claim 14, wherein said counter assembly comprises a plurality of rigid panels joined to one another so as to provide a substantially monocoque structure, said panels including:

a front panel;

a pair of outer side panels extending away from said front panel along either side of said counter assembly; and at least one interior front panel positioned within the interior of said counter assembly in a substantially facing, spaced-apart relationship from said front panel;

wherein at least a portion of said air plenum and at least a portion of said wire chase are located between said front panel and said at least one interior front panel.

18. The modular transaction station of claim 17, wherein said plurality of panels further includes a pair of interior side panels, positioned within the interior of said counter assembly in a substantially facing, spaced-apart relationship from said outer side panels, and a substantially horizontal top panel.

19. The modular transaction station of claim 18, wherein said interior side panels are positioned in a facing, spaced-apart relationship to one another so as to define a central opening in said counter assembly therebetween, such that an attendant may locate themselves within said central opening when using said transaction station.

20. The modular transaction station of claim 19, wherein said counter assembly has a top panel and a transaction drawer moveable between extended and retracted positions, and wherein said air plenum extends upwardly along either side of said transaction drawer within said counter assembly such that air may be directed from the interior of the counter assembly away from the top panel of said counter assembly.

21. A modular transaction station, comprising:

(a) a frame having upper and lower portions, and a window positioned in said upper portion, wherein said frame may be secured within an opening in a structure; and (b) a counter assembly attached to the lower portion of said frame; wherein said counter assembly comprises a plurality of rigid panels joined to one another so as to provide a substantially monocoque structure, said panels including a front panel, a pair of outer side panels, and at least one interior panel positioned within the interior of said counter assembly in a substantially facing, spaced-apart relationship from at least one of said front panel and said side panels.

22. The modular transaction station of claim 21, wherein each of said panels comprises a steel sheet, and wherein said panels are initially secured to one another by riveting, and are thereafter welded to one another to form a rigid, monocoque structure.

23. The modular transaction station of claim 21, wherein said outer side panels extend away from said front panel along either side of said counter assembly; and said at least one interior panel is positioned within the interior of said counter assembly in a substantially facing, spaced-apart relationship from said front panel.

24. The modular transaction station of claim 23, further comprising an air plenum within said counter assembly, at least a portion of said air plenum located between said front panel and said at least one interior panel.

25. The modular transaction station of claim 24, further comprising a heater assembly for directing heated air through said air plenum.

26. The modular transaction station of claim 24, further comprising a wire chase for routing electrical wiring within the interior of said counter assembly, at least a portion of said wire chase located between said front panel and said at least one interior panel.

27. The modular transaction station of claim 21, wherein a pair of said interior panels are provided, each of said pair of interior panels positioned within the interior of said counter assembly in a substantially facing, spaced-apart relationship from one of said outer side panels, and further comprising a substantially horizontal top panel.

28. The modular transaction station of claim 27, wherein a plurality of said panels each have at least one flange along an edge thereof, said flanges having a plurality of apertures extending therethrough, said apertures in said flanges corresponding to apertures in an adjacent panel, and a plurality of fastening devices secured within corresponding apertures on adjacent panels so as to secure the panels to one another.

29. The modular transaction station of claim 27, wherein said interior side panels are positioned in a facing, spaced-apart relationship to one another so as to define a central opening in said counter assembly therebetween, such that an attendant may locate themselves within said central opening when using said transaction station.

30. The modular transaction station of claim 21, wherein said counter assembly has a top panel and a transaction drawer moveable between extended and retracted positions, and wherein said air plenum extends upwardly along either side of said transaction drawer within said counter assembly such that air may be directed from the interior of the counter assembly away from the top panel of said counter assembly.

* * * * *

UNITED STATES PATENT AND TRADEMARK OFFICE

CERTIFICATE OF CORRECTION

PATENT NO. : 6,006,681

DATED : December 28, 1999

INVENTOR(S) : Michael E. Brown, et al.

It is certified that error appears in the above-identified patent and that said Letters Patent is hereby corrected as shown below:

Claim 17, column 21, line 54, replace "14" with --13--.

Signed and Sealed this

Twenty-fourth Day of October, 2000

*Attest:*

*Attesting Officer*

Q. TODD DICKINSON

*Director of Patents and Trademarks*